US006231391B1

(12) United States Patent
Ramey et al.

(10) Patent No.: US 6,231,391 B1
(45) **Date of Patent: *May 15, 2001**

(54) CONNECTOR APPARATUS

(75) Inventors: Samuel C. Ramey; Kevin R. Meredith; Alexander W. Barr, all of Louisvillle, KY (US); Johannes Petrus Maria Kusters, New Albany, IN (US)

(73) Assignee: Robinson Nugent, Inc., New Albany, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/564,239

(22) Filed: May 4, 2000

Related U.S. Application Data

(63) Continuation of application No. 09/373,147, filed on Aug. 12, 1999.

(51) Int. Cl.[7] ..... H01R 13/648
(52) U.S. Cl. ..... 439/608
(58) Field of Search ..... 439/608, 607, 439/609, 108, 101, 97, 894, 901, 904

(56) References Cited

U.S. PATENT DOCUMENTS

| | | | |
|---|---|---|---|
| 4,226,499 | 10/1980 | Bauerle . | |
| 4,538,866 | 9/1985 | Johnson . | |
| 4,655,518 | 4/1987 | Johnson et al. . | |
| 4,659,155 | 4/1987 | Walkup et al. . | |
| 4,724,180 | 2/1988 | Kern . | |
| 4,836,791 | 6/1989 | Grabbe et al. . | |
| 4,846,727 | 7/1989 | Glover et al. . | |
| 4,854,899 * | 8/1989 | Matthews | 439/724 |

(List continued on next page.)

FOREIGN PATENT DOCUMENTS

| | | |
|---|---|---|
| 3605316 A1 | 8/1987 | (DE) . |
| 3904461 C1 | 9/1990 | (DE) . |
| 29610780 | 8/1996 | (DE) . |
| 0 746 060 | 12/1996 | (EP) . |
| 0746060 A2 | 12/1996 | (EP) . |
| 0769828 A2 | 9/1997 | (EP) . |
| 0854549 A2 | 7/1998 | (EP) . |
| 0865113 A2 | 9/1998 | (EP) . |
| 0907225 A2 | 4/1999 | (EP) . |
| 2315614 | 2/1998 | (GB) . |
| WO 94/16477 | 7/1994 | (WO) . |
| WO 98/00889 | 1/1998 | (WO) . |
| WO 98/10492 | 3/1998 | (WO) . |
| WO 98/19370 | 5/1998 | (WO) . |
| WO 98/24154 | 6/1998 | (WO) . |
| WO 98/35408 | 8/1998 | (WO) . |
| WO 98/35409 | 8/1998 | (WO) . |
| WO 98/48485 | 10/1998 | (WO) . |

*Primary Examiner*—Gary F. Paumen
*Assistant Examiner*—Phuongchi Nguyen
(74) *Attorney, Agent, or Firm*—Barnes & Thornburg

(57) ABSTRACT

An electrical header connector of the present invention includes a header body formed to include a plurality of first openings and a plurality of second openings. The header body having a front wall and a back wall. A plurality of signal pins are configured for insertion into the plurality of first openings. Each signal pin includes a first end extending from the front wall of the header body to form an array of pin contacts, and a second end spaced apart from the first end and extending from the back wall of the header body. A plurality of shield blades are configured for insertion into the plurality of second openings. Each of the plurality of shield blades has a first end extending from the front wall of the header body adjacent to the first end of a signal pin, a second end extending from the back wall of the header body adjacent to the second end of the signal pin, and a generally right angle shielding portion configured to be disposed adjacent to an intermediate portion of the signal pin. The first and second openings are arranged in the header body such that the generally right angle shielding portions of shield blades substantially surround the signal pins to form a coaxial shield around each of the plurality of signal pins.

9 Claims, 22 Drawing Sheets

U.S. PATENT DOCUMENTS

| | | |
|---|---|---|
| 4,867,690 | 9/1989 | Thumma . |
| 4,869,677 | 9/1989 | Johnson et al. . |
| 4,871,321 | 10/1989 | Johnson . |
| 4,909,743 | 3/1990 | Johnson et al. . |
| 4,932,888 | 6/1990 | Senor . |
| 4,975,084 | 12/1990 | Fedder et al. . |
| 5,046,960 | 9/1991 | Fedder . |
| 5,066,236 | 11/1991 | Broeksteeg . |
| 5,104,341 | 4/1992 | Gilissen et al. . |
| 5,133,679 | 7/1992 | Fusselman et al. . |
| 5,135,405 | 8/1992 | Fusselman et al. . |
| 5,137,472 | 8/1992 | Hillbish et al. . |
| 5,141,445 | 8/1992 | Little . |
| 5,175,928 | 1/1993 | Grabbe . |
| 5,228,871 | 7/1993 | Goodman . |
| 5,281,161 | 1/1994 | Kanai . |
| 5,282,752 | 2/1994 | Doutrich et al. . |
| 5,286,212 | 2/1994 | Broeksteeg . |
| 5,342,211 | 8/1994 | Broeksteeg . |
| 5,360,349 | 11/1994 | Provencher et al. . |
| 5,403,206 | 4/1995 | McNamara et al. . |
| 5,484,310 | 1/1996 | McNamara et al. . |
| 5,500,788 | 3/1996 | Longueville et al. . |
| 5,518,422 | 5/1996 | Zell et al. . |
| 5,595,490 | 1/1997 | Cohen et al. . |
| 5,605,476 | 2/1997 | McNamara et al. . |
| 5,607,326 | 3/1997 | McNamara et al. . |
| 5,620,340 | 4/1997 | Andrews . |
| 5,632,635 | 5/1997 | Vanbesien et al. . |
| 5,664,968 | 9/1997 | Mickievicz . |
| 5,672,064 | 9/1997 | Provencher et al. . |
| 5,700,164 | 12/1997 | Weidler et al. . |
| 5,702,258 | 12/1997 | Provencher et al. . |
| 5,704,793 | 1/1998 | Stokoe et al. . |
| 5,738,544 | 4/1998 | Davis . |
| 5,755,595 | 5/1998 | Davis et al. . |
| 5,788,537 | 8/1998 | Davis et al. . |
| 5,788,538 | 8/1998 | Belopolsky et al. . |
| 5,795,191 | 8/1998 | Preputnick et al. . |
| 5,797,770 | 8/1998 | Davis et al. . |
| 5,820,397 | 10/1998 | Stokoe et al. . |
| 5,820,412 | 10/1998 | Koegel et al. . |
| 5,851,121 | 12/1998 | Thenaisie et al. . |
| 5,860,816 | 1/1999 | Provencher et al. . |
| 5,863,222 | 1/1999 | Kinsey, Jr. et al. . |
| 5,876,247 | 3/1999 | Hashimoto . |
| 5,904,594 | 5/1999 | Longueville et al. . |
| 5,980,321 | 11/1999 | Cohen et al. . |

* cited by examiner

CONNECTOR APPARATUS

This application is a continuation of U.S. patent application, Ser. No. 09/373,147, filed on Aug. 12, 1999, and entitled "Connector Apparatus".

BACKGROUND AND SUMMARY OF THE INVENTION

This invention relates to two-part electrical connectors, and particularly to two-part high-speed backplane electrical connectors. More particularly, this invention relates to improvements in shielded two-part high-speed backplane electrical connectors.

Conductors carrying high frequency signals and currents are subject to interference and cross talk when placed in close proximity to other conductors carrying high frequency signals and currents. This interference and cross talk can result in signal degradation and errors in signal reception. Coaxial and shielded cables are available to carry signals from a transmission point to a reception point, and reduce the likelihood that the signal carried in one shielded or coaxial cable will interfere with the signal carried by another shielded or coaxial cable in close proximity. However, at points of connection, the shielding is often lost allowing interference and crosstalk between signals. The use of individual shielded wires and cables is not desirable at points of connections due to the need for making a large number of connections in a very small space. In these circumstances, two-part high-speed backplane electrical connectors containing multiple shielded conductive paths are used.

This design is based on, but not limited to, the industry standard for a two-part high-speed backplane electrical connector for electrically coupling a motherboard (also known as "backplane") to a daughtercard is set forth in the United States by specification IEC 1076-4-101 from the International Electrotechnical Commission. This specification sets out parameters for 2 mm, two-part connectors for use with printed circuit boards. The IEC specification defines a socket connector that includes female receptacle contacts and a header connector that contains male pin contacts configured for insertion into the female receptacle contacts of the socket connector.

A two-part high-speed backplane electrical connector with improved electromagnetic shielding comprises a socket connector and a header connector. The socket connector includes a plurality of connector modules. Each connector module includes an insulated material encasing a plurality of conductive paths. Each connector module is formed to include a plurality of laterally-extending openings which are interleaved with the plurality of conductive paths. The socket connector further includes a plurality of shields including first shield portions extending along first sides of the plurality of connector modules, and second shield portions extending into the laterally-extending openings in the plurality of connector modules to form a coaxial shield around each conductive path.

According to the present invention, a header connector includes a header body formed to include a plurality of first openings and a plurality of second openings. A plurality of signal pins are configured for insertion into the plurality of first openings to form an array of pin contacts extending therefrom. A plurality of shield blades are configured for insertion into the plurality of second openings. Each of the plurality of shield blades is formed to include a generally right angle shielding portion configured to be disposed adjacent to at least one of the plurality of signal pins to form a coaxial shield around each signal pin.

According to a further aspect of the invention, the generally right angle shielding portion of each of the plurality of shield blades includes first and second leg portions. Each of the plurality of second openings in the header body has a generally right angle cross-section for receiving the generally right angle shielding portion of a shield blade. Each generally right angle second opening includes first and second narrowed portions dimensioned to engage the first and second leg portions of the generally right angle shielding portion of a shield blade to hold the shield blade in place.

In accordance with another aspect of the invention, each of the plurality of generally right angle second openings in the header body includes a central portion coupled to first and second end portions by the first and second narrowed portions. The central portion and the first and second end portions of each generally right angle second opening are formed to provide an air gap surrounding the generally right angle shielding portion of a shield blade. The geometry and dimensions of the air gaps, the geometry, dimensions and material of the right angle shielding portions, and the geometry, dimensions and material of the header body surrounding the air gaps are configured to tune the header connector to match a specified impedance.

A protective cap according to still another aspect of the present invention includes a front wall formed to include a plurality of blind holes configured to receive first ends of the signal pins of the header connector when the protective cap is inserted into the header body to protect the signal pins during shipping and handling of the header connector to a customer's facility. The protective cap include a surface configured to engage a portion of the header body surrounding the signal pins, and the blind holes include a surface configured to engage a portion of the signal pins to permit the protective cap to be used as a termination tool to press fit the header connector on the printed circuit board at the customer's facility.

Additional features of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

having eight forwardly-extending shield fingers and eight downwardly-extending shield tails configured to be to extend along a first side of the connector module so that eight forwardly-extending shield fingers of the vertical stripline shield are generally aligned with eight forwardly-extending receptacle contacts of the connector module and eight downwardly-extending shield tails of the vertical stripline shield are disposed adjacent to the eight downwardly-extending pin tails of the connector module, both the connector modules and the stripline shields having eight laterally-extending angled passageways therethrough into which eight laterally-extending angled tailshields (sometimes referred to herein as "second shields") are inserted to form a coaxial shield around each conductive path in the connector modules.

DETAILED DESCRIPTION OF THE DRAWINGS

While the connector assembly in accordance with the present invention may be designed to facilitate making any number of simultaneous electrical connections, the illustrated connector assembly is designed to facilitate making electrical connections which are a multiple of eight (8). Specifically, it will be understood that the connector assembly in accordance with the present invention may be designed to facilitate making electrical connections which are a multiple of any other number, such as two (2).

Figure 1:
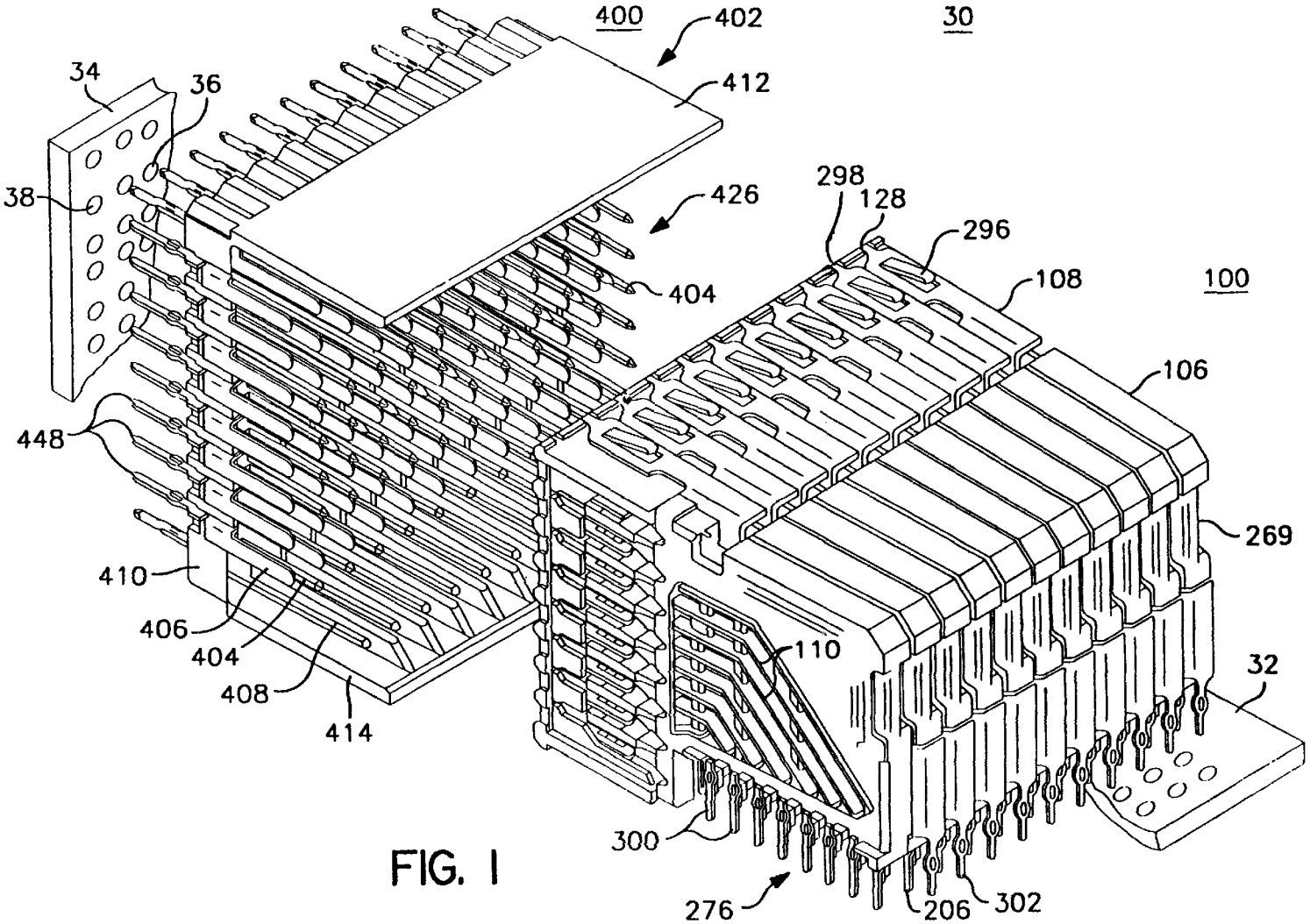
FIG. 1 is a perspective view of a connector assembly in accordance with the present invention showing a socket connector having an array of female receptacle contacts positioned for insertion into a header connector having a corresponding array of male pin contacts.
Figure 2:
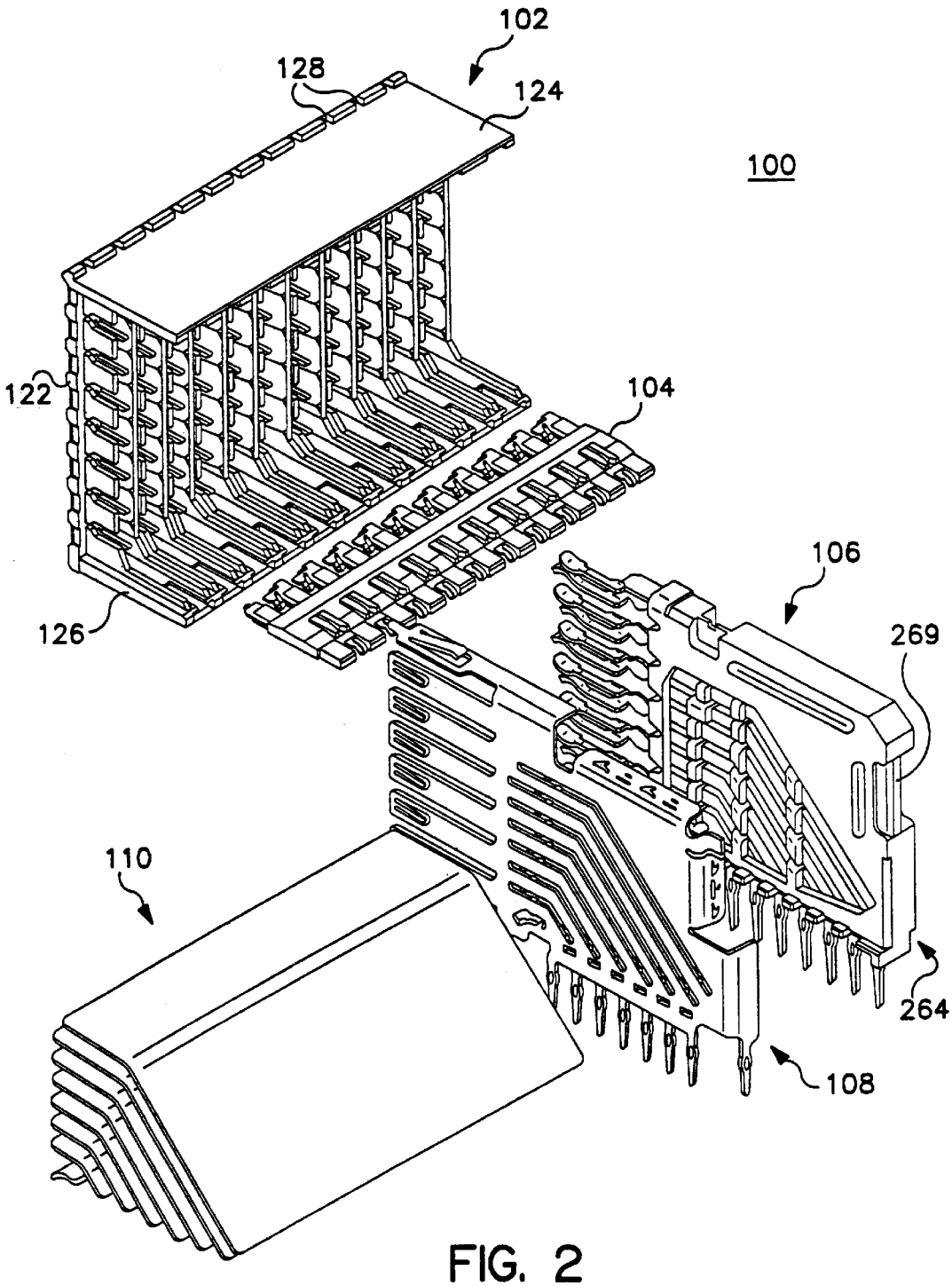
FIG. 2 is an exploded view of the socket connector of FIG. 1 in accordance with one aspect of the present invention, and showing, from left to right, a front cap including a front wall having an inner surface formed to include a plurality of vertically-extending rectangular dividers, one of seven horizontal shields (sometimes referred to herein as "third shields") configured for insertion into one of seven laterally-extending slots in the vertically-extending rectangular dividers to form eight laterally-extending compartments, one of a plurality of connector modules having eight forwardly-extending female receptacle contacts internally coupled to eight downwardly-extending pin tails, one of a plurality of vertical stripline shields (sometimes referred to herein as "first shields")

Referring now to the drawings, FIG. 1 illustrates a two-part connector assembly 30 in accordance with the present invention including a socket connector 100 configured to be coupled to a daughtercard 32, and a header connector 400 configured to be coupled to a motherboard 34. FIG. 2 illustrates an exploded perspective view of the socket connector 100 in accordance with one aspect of the present invention. The socket connector 100 includes a front cap 102, seven horizontal shields 104 (sometimes referenced to herein as "third shields"), a plurality of connector modules 106 (also known as "wafers"), a plurality of vertical stripline shields 108 (sometimes referenced to herein as "first shields" or "first shield portions"), and eight laterally-extending angled tailshields 110 (sometimes referenced to herein as "second shields" or "second shield portions"). For the sake of clarity, only one each of the seven horizontal shields 104, the plurality of connector modules 106 and the plurality of vertical stripline shields 108 are shown in FIG. 2.

Figure 3:
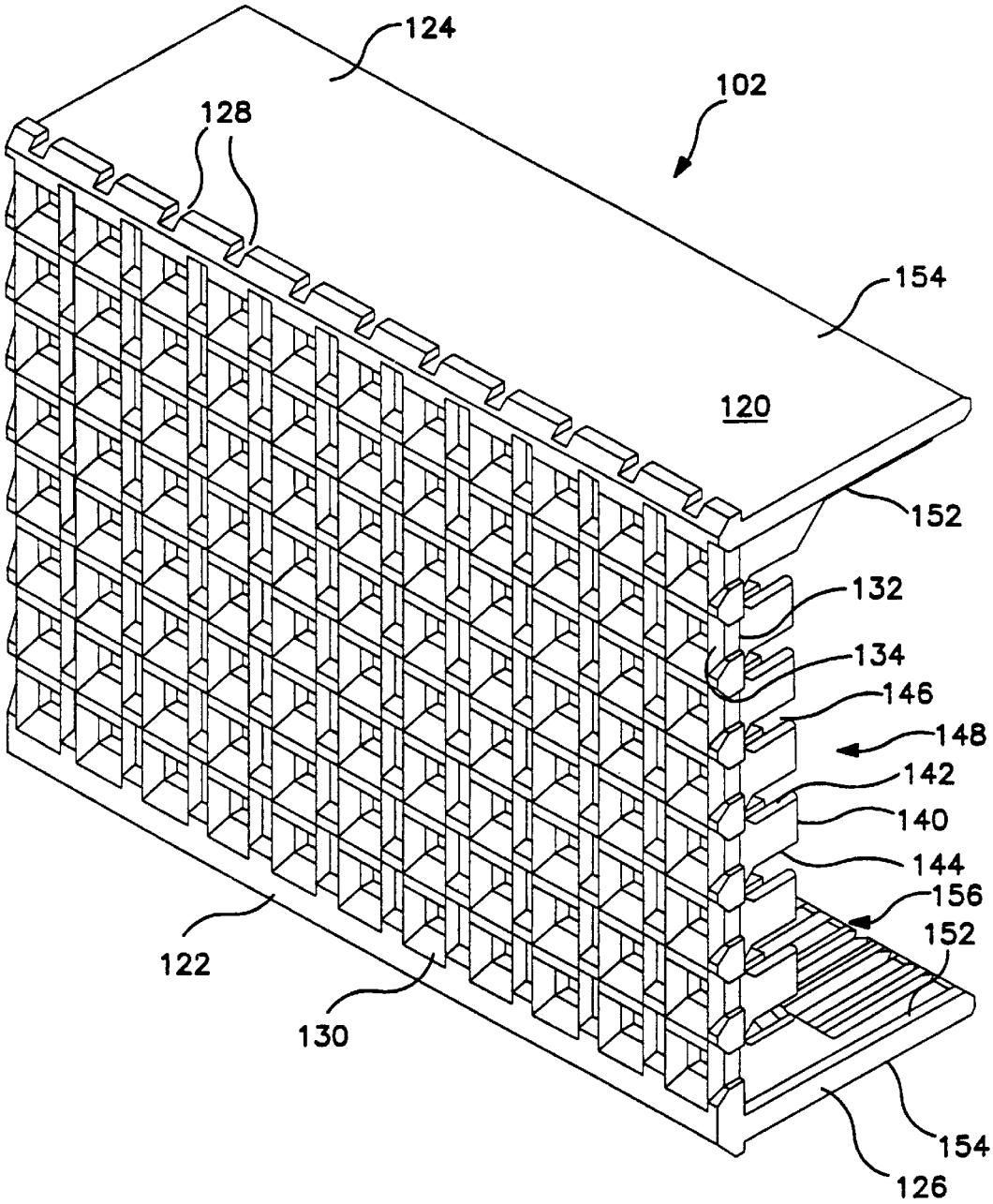
FIG. 3 is a perspective view of the front cap of FIG. 2 rotated anticlockwise approximately 60 degrees from the orientation shown in FIG. 2, and showing an array of pin-insertion windows formed in the front wall, the array of pin-insertion windows being arranged in columns of eight pin-insertion windows.
Figure 4:
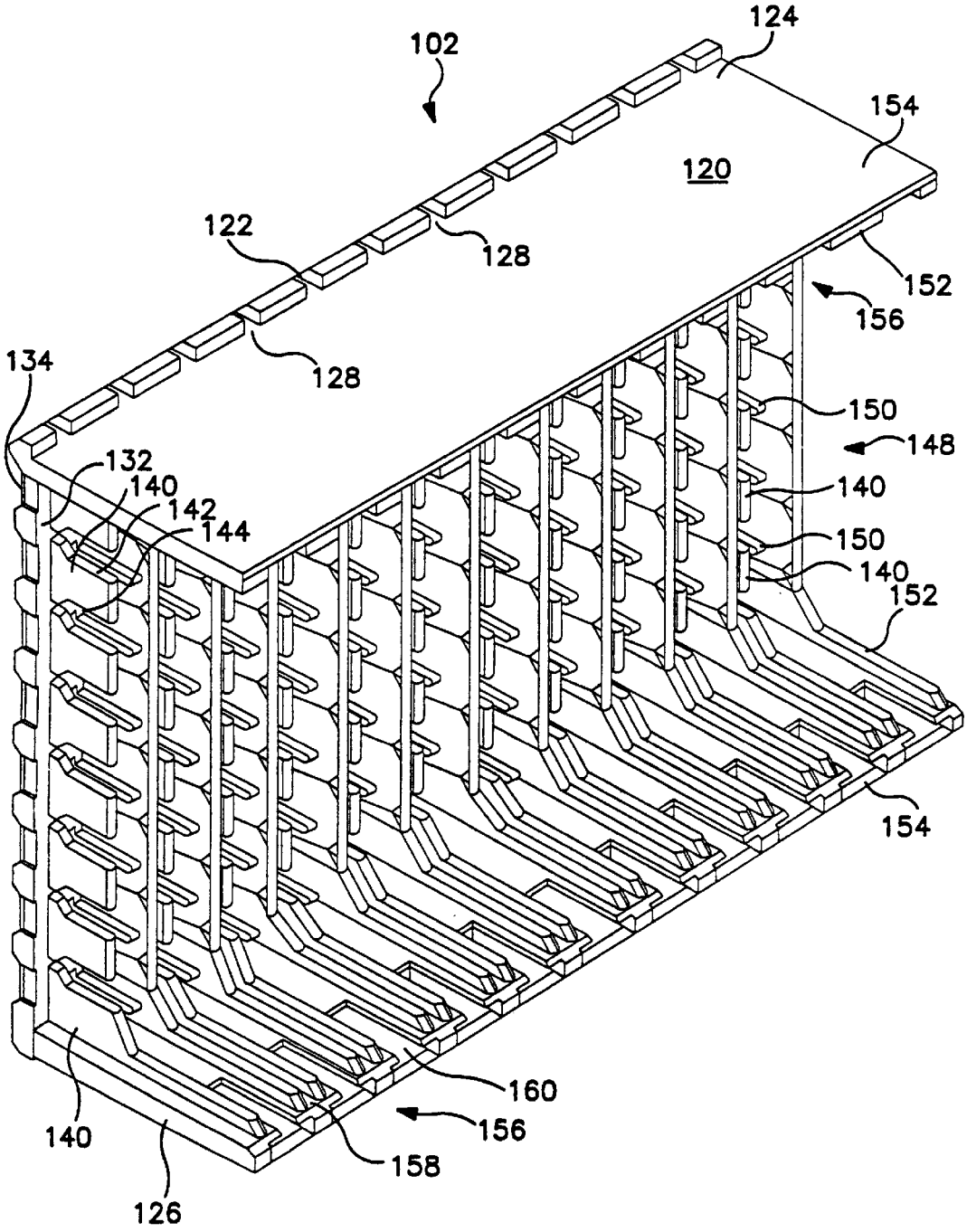
FIG. 4 is a perspective view of the front cap of FIGS. 2–3 shown in the same orientation as shown in FIG. 2, and more fully showing vertically-extending rectangular dividers projecting inwardly from the front wall for horizontally separating the receptacle contacts of the connector modules and for vertically separating the horizontal shields, and further showing a plurality of preopening fingers projecting inwardly from the front wall and arranged for insertion into opposed cantilevered fingers of the receptacle contacts for facilitating insertion of pin contacts of the header connector therein, and a plurality of guide slots formed in the internal surfaces of the top and bottom laterally-extending walls of the front cap for guiding insertion of the connector modules and vertical stripline shields therein.

As shown more clearly in FIGS. 3 and 4, the front cap 102 includes a housing 120 made from insulating material, and having a generally vertically-extending front wall 122 and a pair of laterally-extending, horizontal top and bottom walls 124 and 126. The front wall 122 is formed to include a plurality pin-insertion windows 130 extending between an internal surface 132 and an external surface 134 thereof. As shown, the plurality of pin-insertion windows 130 are arranged in a grid form as an array of vertical columns and horizontal rows. In the illustrated embodiment, there are eight pin-insertion windows 130 in each column. The internal surface 132 of the front wall 122 is formed to include a plurality of inwardly-extending, rectangular vertical dividers 140 having top surfaces 142 and bottom surfaces 144. The top surfaces 142 of rectangular dividers 140 and the bottom surfaces 144 of the adjacent higher rectangular dividers 140 cooperate to define seven laterally-extending, horizontal slots 146 into which seven horizontal shields 104 are inserted to form eight horizontal compartments 148 in substantial alignment with eight rows of pin-insertion windows 130. Eight horizontal compartments 148 formed in the front cap 102 are configured to receive eight forwardly-extending receptacle contacts 204 of the connector modules 106 and eight forwardly-extending shield fingers 274 of the vertical stripline shields 108 when the connector modules 106 and the vertical stripline shields 108 are inserted into the front cap 102.

Figure 22:
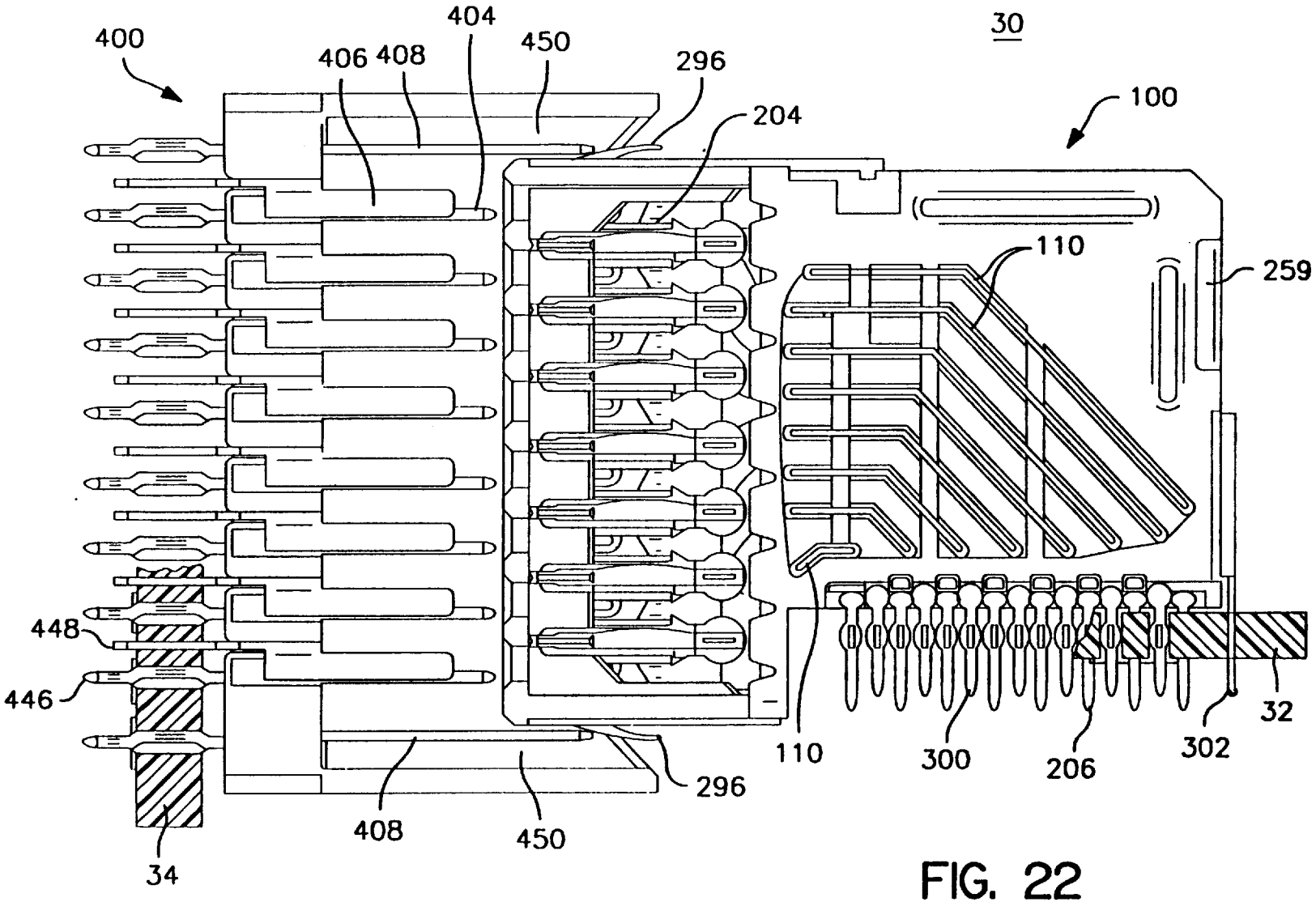
FIG. 22 shows a socket connector partially inserted into a header connector so that the array of pin-insertion windows in the socket connector are aligned with the array of pin contacts in the header connector prior to the reception of the pin contacts in the header connector in the receptacle contacts in the socket connector.
Figure 23:
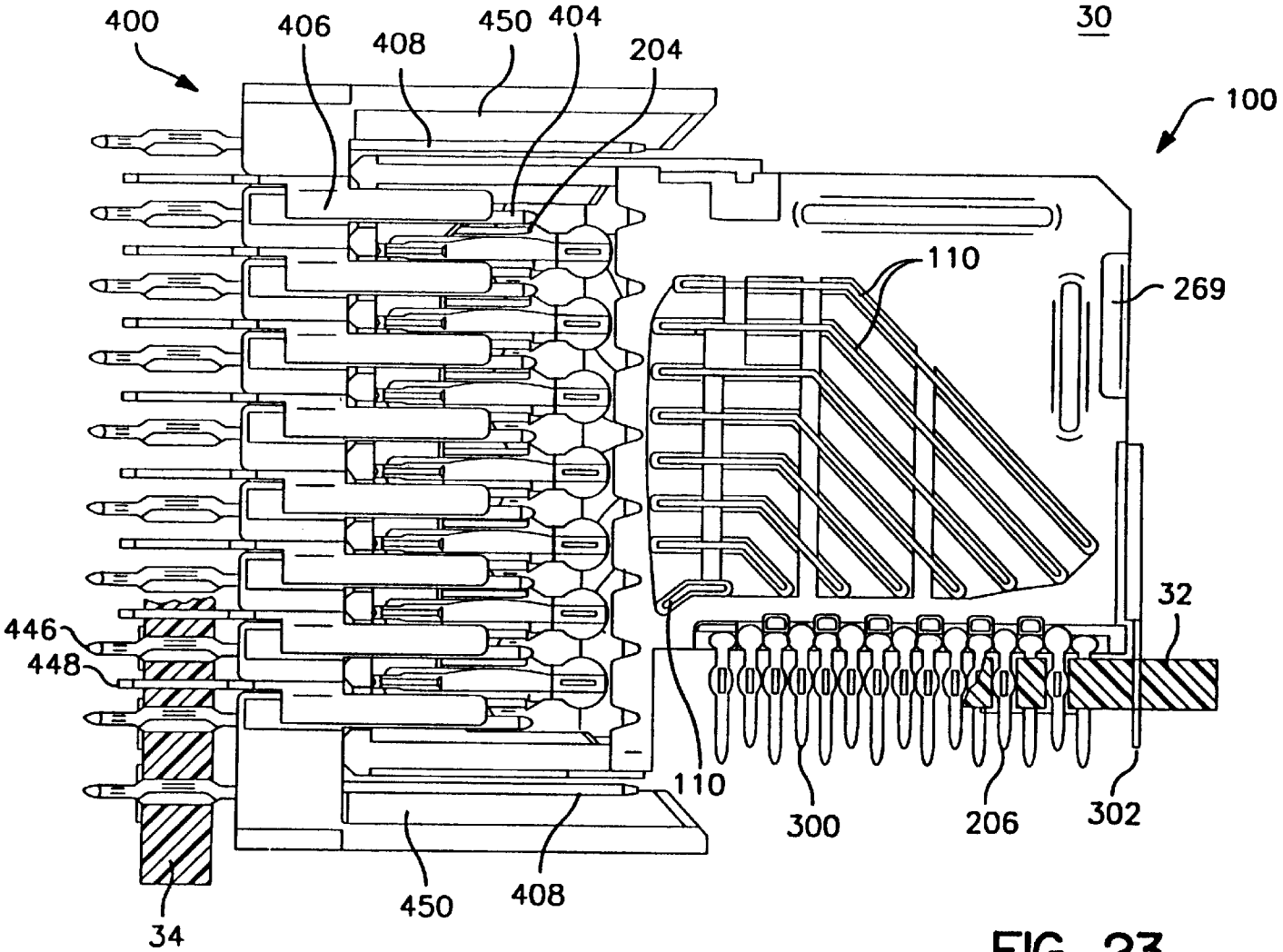
FIG. 23 shows the socket connector fully inserted into the header connector so that the pin contacts of the header connector are received in the receptacle contacts of the socket connector, shield blades of the header connector are in engagement with the shield fingers of the socket connector, and the ground pins of the header connector are in engagement with the contact arms of the socket connector.

The internal surface 132 of the front wall 122 is further formed to include a plurality of inwardly-extending, pre-opening fingers 150, which are configured for insertion between opposed cantilevered beams 208 of the receptacle contacts 204 of the socket connector 100 to keep the cantilevered beams 208 separated. This facilitates insertion of signal pins 404 of the header connector 400 into the receptacle contacts 204 of the socket connector 100 when the two are mated as shown in FIGS. 22 and 23.

Figure 5:
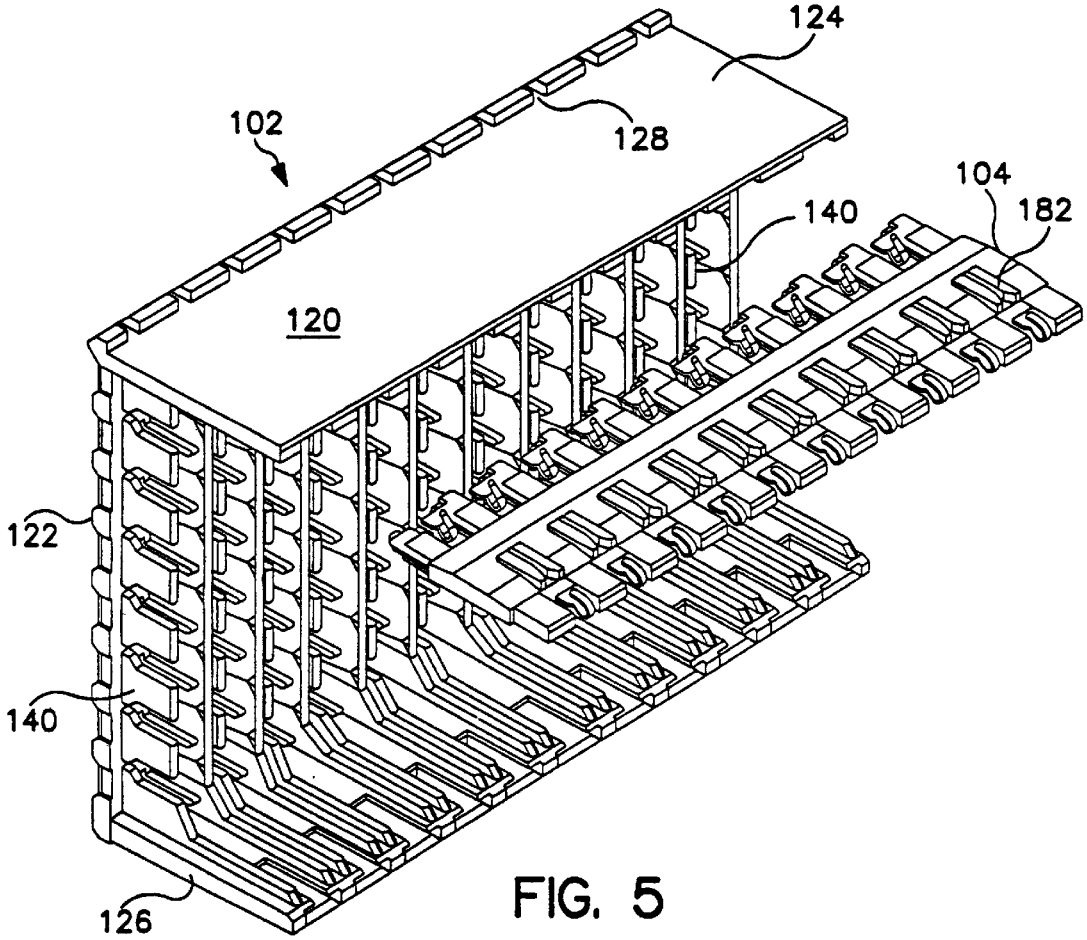
FIG. 5 is a perspective view of one of seven horizontal shields configured to be inserted into one of seven laterally-extending slots between the inwardly-extending rectangular dividers in the front cap, seven horizontal shields forming eight laterally-extending compartments in the front cap for vertically separating and shielding eight receptacle contacts of the connector modules from each other.
Figure 6:
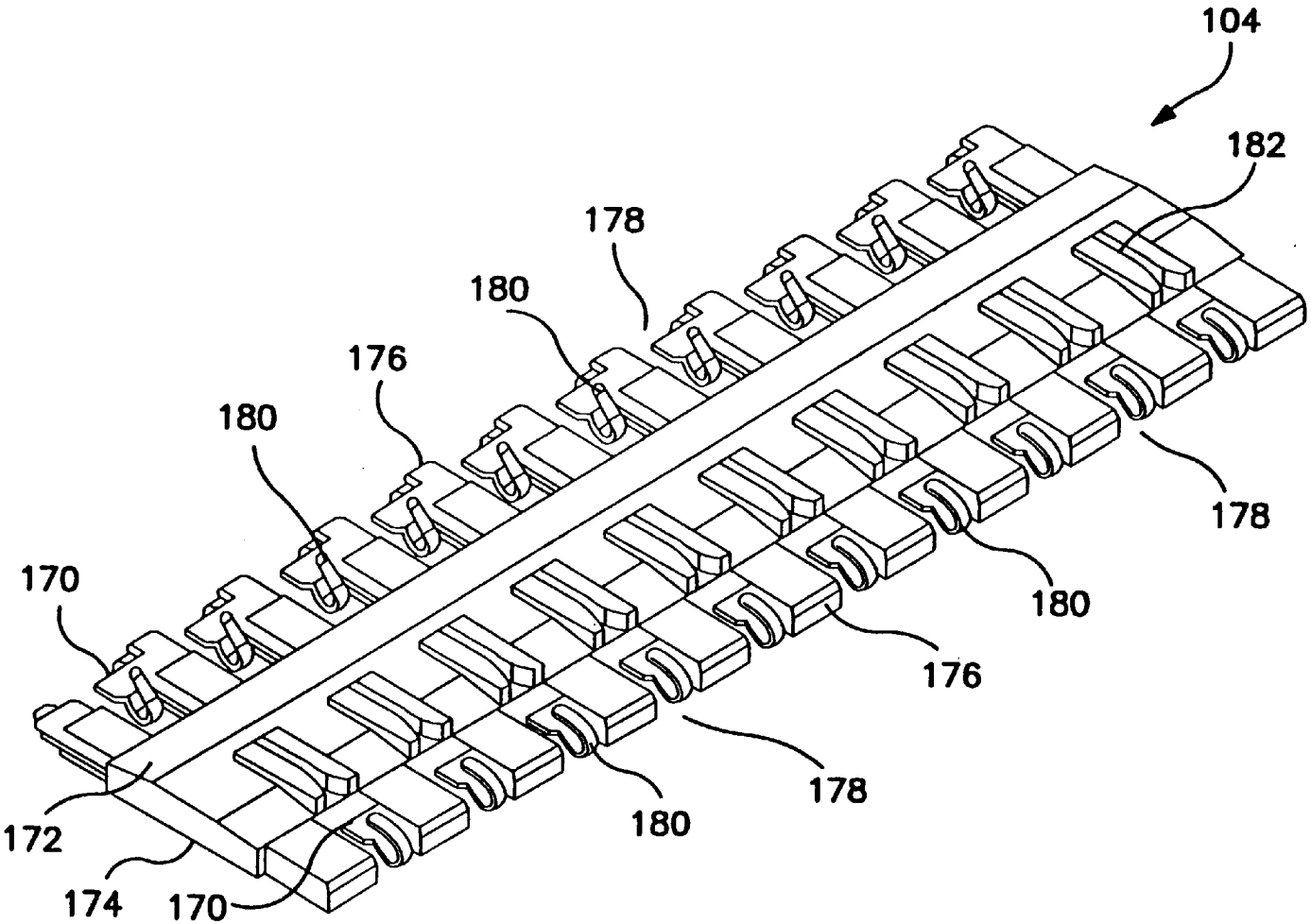
FIG. 6 is an enlarged perspective view of the horizontal shield including an inner layer of shielding material sandwiched between two outer layers of insulating material, the front and back edges of the horizontal shields being formed to include a plurality of cutouts through which a plurality of flexible contacts of the inner shielding layer project for electrically contacting the forwardly-extending shield fingers of the vertical stripline shields near the front and back of the horizontal shields when the connector modules and vertical stripline shields are inserted into the front cap to form a coaxial shield around each receptacle contact.
Figure 11:
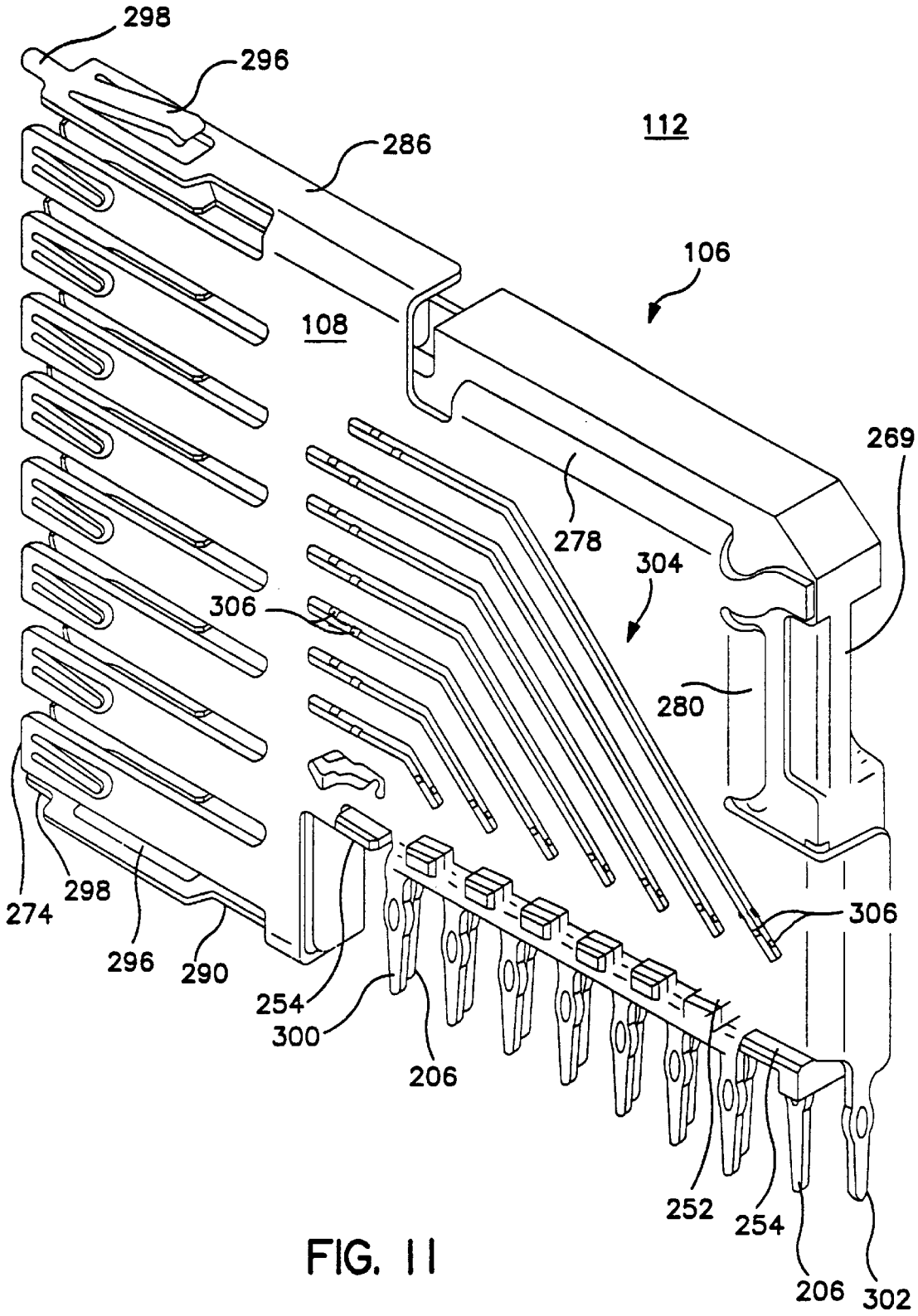
FIG. 11 is a perspective view of a paired connector unit showing a vertical stripline shield press fitted to an associated connector module so that eight forwardly-extending shield fingers of the vertical stripline shield are aligned with eight forwardly-extending receptacle contacts of the connector module, eight downwardly-extending shield tails of the vertical stripline shield are disposed adjacent to eight downwardly-extending pin tails of the connector module, eight laterally-extending angled passageways in the vertical stripline shield are aligned with eight laterally-extending angled passageways in the connector module, six small tabs of the connector module are received in six small apertures in the vertical stripline shield, two large tabs of the connector module are received in two large slots in the vertical stripline shield, a horizontal cantilevered flange of the vertical stripline shield is inserted into the horizontal recess in the connector module, and a vertical cantilevered flange of the vertical stripline shield is inserted into the vertical recess in the connector module.

The laterally-extending top and bottom walls 124 and 126 each include internal surfaces 152 and external surfaces 154. The internal surfaces 152 of the top and bottom walls 124 and 126 are formed to include a plurality of inwardly-extending guide slots 156 extending substantially perpendicularly therefrom for guiding insertion of a plurality of paired connector units 112, each comprising a vertical stripline shield 108 coupled to a connector module 106 along a first side 232 thereof as shown in FIG. 11. The plurality of guide slots 156 are arranged in pairs—a narrower guide slot 158 for guiding insertion of a vertical stripline shield 108 and an adjacent broader guide slot 160 for guiding insertion of an associated connector module 106. The front cap 102 may be formed to include vertical end walls (not shown) extending between the laterally-extending top and bottom walls 124 and 126 at the opposite ends thereof FIGS. 5 shows one of seven horizontal shields 104 (also referred to herein as "third shields") positioned to be inserted into one of seven laterally-extending slots 146 formed in the front cap 102. Each horizontal shield 104 includes an inner layer of shielding material 170 sandwiched between outer layers of insulating material 172 and 174 as shown in FIG. 6. The horizontal shields 104 may be formed as a continuous strip by using insertmolding process. The front and back edges 176 of each horizontal shield 104 are formed to include a plurality of cutouts 178 through which a plurality of flexible contacts 180 formed in the inner shielding layer 170 project. The flexible contacts 180 of the horizontal shields 104 are configured to electrically engage the forwardly-extending shield fingers 274 of the vertical stripline shields 108 at the front and back ends of the forwardly-extending shield fingers 274 upon insertion of the vertical stripline shields 108 into the front cap 102. The lateral spacing between the flexible contacts 180 of the horizontal shields 104 is the same as the lateral spacing between the forwardly-extending shield fingers 274 of the vertical stripline shields when the vertical stripline shields 108 are inserted into the front cap 102. The horizontal shields 104 are formed to include guide slots 182 for guiding insertion of the vertical stripline shields 108 into the front cap 102 so that the forwardly-extending shield fingers 274 of the vertical stripline shields 108 are aligned with the flexible contacts 180 of the horizontal shields 104. The outer insulating layers 172 and 174 of the horizontal shields 104 vertically separate and insulate the female receptacle contacts 204 of the connector modules 106 from each other. On the other hand, the inner shielding layers 170 of the horizontal shields 104 vertically shield the female receptacle contacts 204 of the connector modules 106 from each other. Thus the horizontal and vertical shields 104 and 108 inserted into the front cap 102 cooperate to form a virtual coaxial shield around each female receptacle contact 204 of the connector modules 106. The use of two flexible contacts 180 at the front and back of the horizontal shields 104 serves to distribute ground currents radially around the receptacle contacts 204, thereby reducing crosstalk between neighboring signals.

Figure 7:
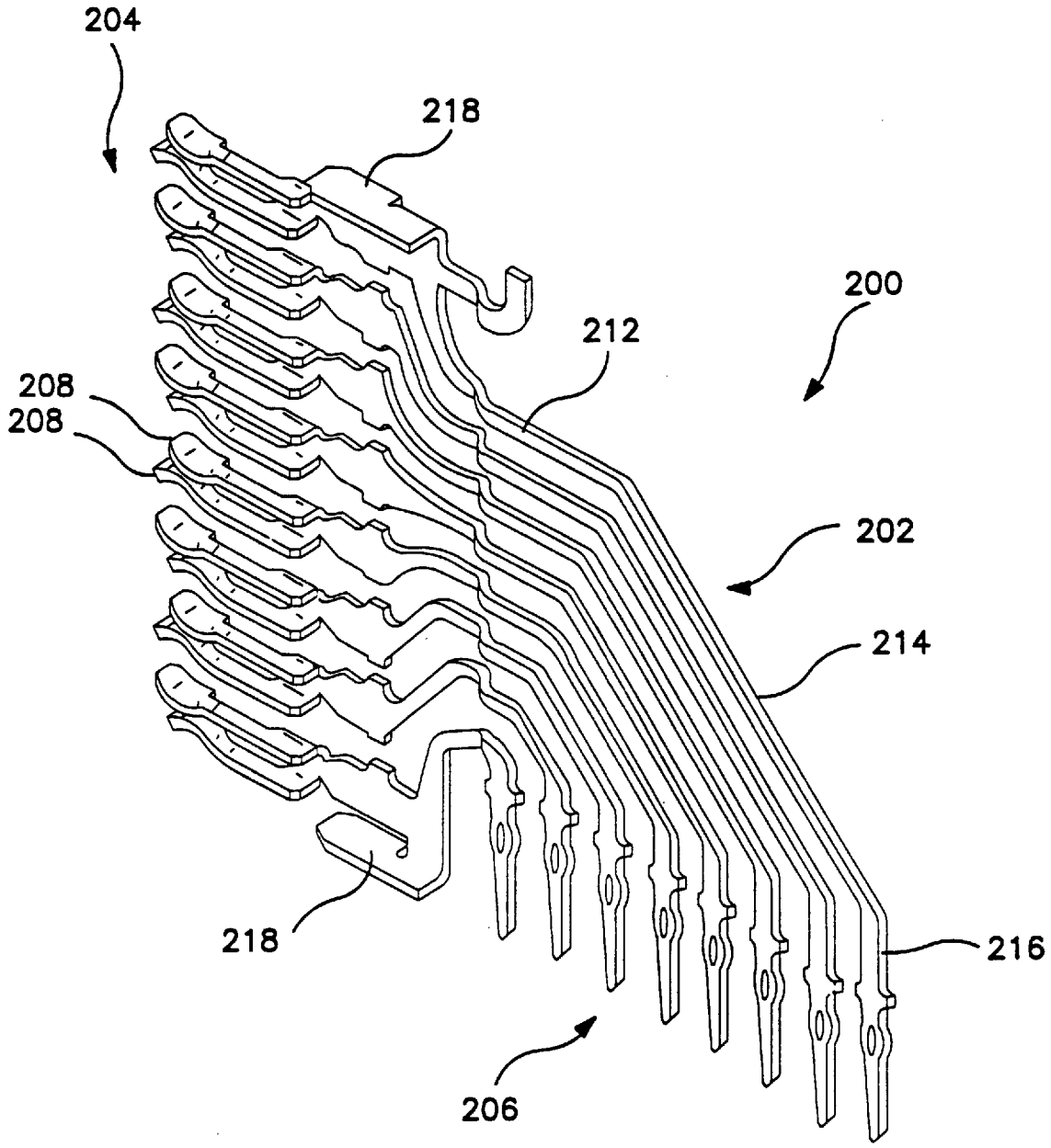
FIG. 7 is a perspective view of contact circuitry encased in the connector module, and showing eight separate conductive paths, each electrically connecting a single forwardly-extending receptacle contact to the left of figure to a corresponding downwardly-extending pin tail to the bottom-right of figure.

FIG. 7 shows the contact circuitry 200 encased in the overmolded connector module 106 made from insulating material. The contact circuitry 200 includes eight individual conductive current paths 202, each electrically connecting a single forwardly-extending receptacle contact 204 to a corresponding downwardly-extending pin tail 206. Each receptacle contact 204 includes a pair of opposed cantilevered beams 208 into which the signal pins 404 of the header connector 400 are inserted when the socket connector 100 and the header connector 400 are mated. Each conductive path 202 is formed to include a first leg portion 212 substantially parallel to an associated receptacle contact 204, a second leg portion 214 at an angle to the first leg portion 212, and a third leg portion 216 substantially parallel to an associated pin tail 206. The top and bottom conductive paths 202 are additionally formed to include retention flanges 218 near the upper and lower receptacle contacts 204.

Figure 8:
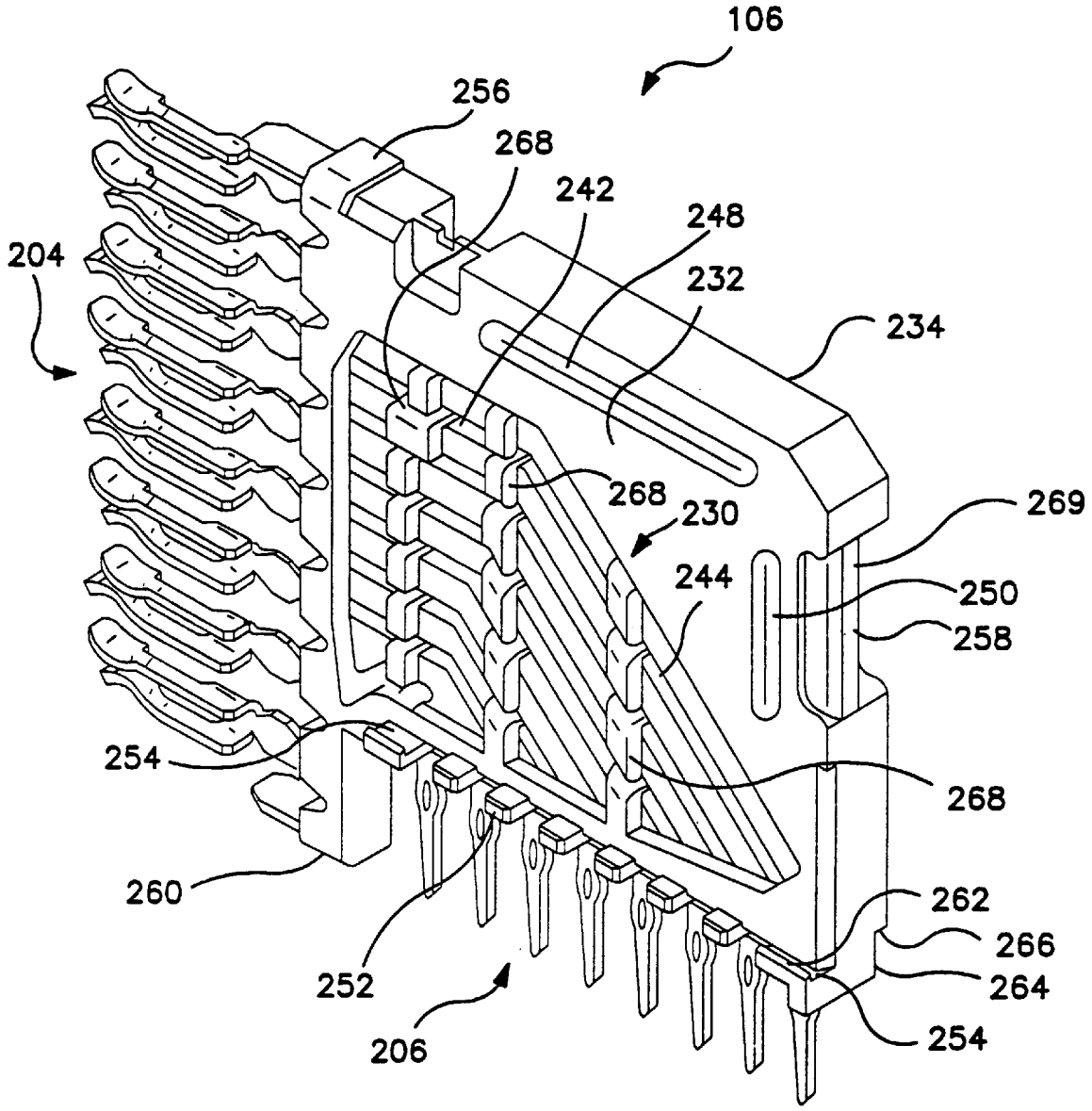
FIG. 8 is a perspective view of one of a plurality of connector modules showing an insulated case encasing eight individual conductive paths, eight forwardly-extending receptacle contacts each having two opposed cantilevered fingers to the left of figure, eight downwardly-extending pin tails to the bottom-right of figure, eight laterally-extending angled passageways therethrough which are interleaved with eight conductive paths therein for receiving eight laterally-extending angled tailshields, a horizontal recess above the uppermost conductive path into which a horizontal cantilevered flange of an associated vertical stripline shield is inserted, a vertical recess to the right of the uppermost conductive path into which a vertical cantilevered flange of the associated vertical stripline shield is inserted, and further showing a number of interlocking features designed to facilitate press fitting of the vertical stripline shield to the connector module.

FIG. 8 shows one of a plurality of connector modules 106 encasing eight individual conductive paths 202. The connector modules 106 may be also formed using insert molding process. The connector module 106 is formed to include eight angled passageways 230 which are interleaved with the eight conductive paths 202, and which extend laterally between first and second sides 232 and 234 of the connector module. As shown, each laterally-extending angled passageway 230 in the connector module 106 includes first and second leg portions 242 and 244 substantially parallel to the first and second leg portions 212 and 214 of an associated conductive path 202. The connector module 106 is formed to include a number of interlocking features for mating with corresponding interlocking features of the vertical stripline shield 108 to ensure good support and alignment therebetween, particularly during press fitting of the socket connector 100 onto a printed circuit board 32. For example, the first side 232 of the connector module 106 is formed to include a horizontal recess 248 above the uppermost conductive path 202, a vertical recess 250 to the right of the uppermost conductive path 202, six small tabs 252 below the lowermost conductive path 202, and two large tabs 254—one on each side of the six small tabs 252.

Figure 9:
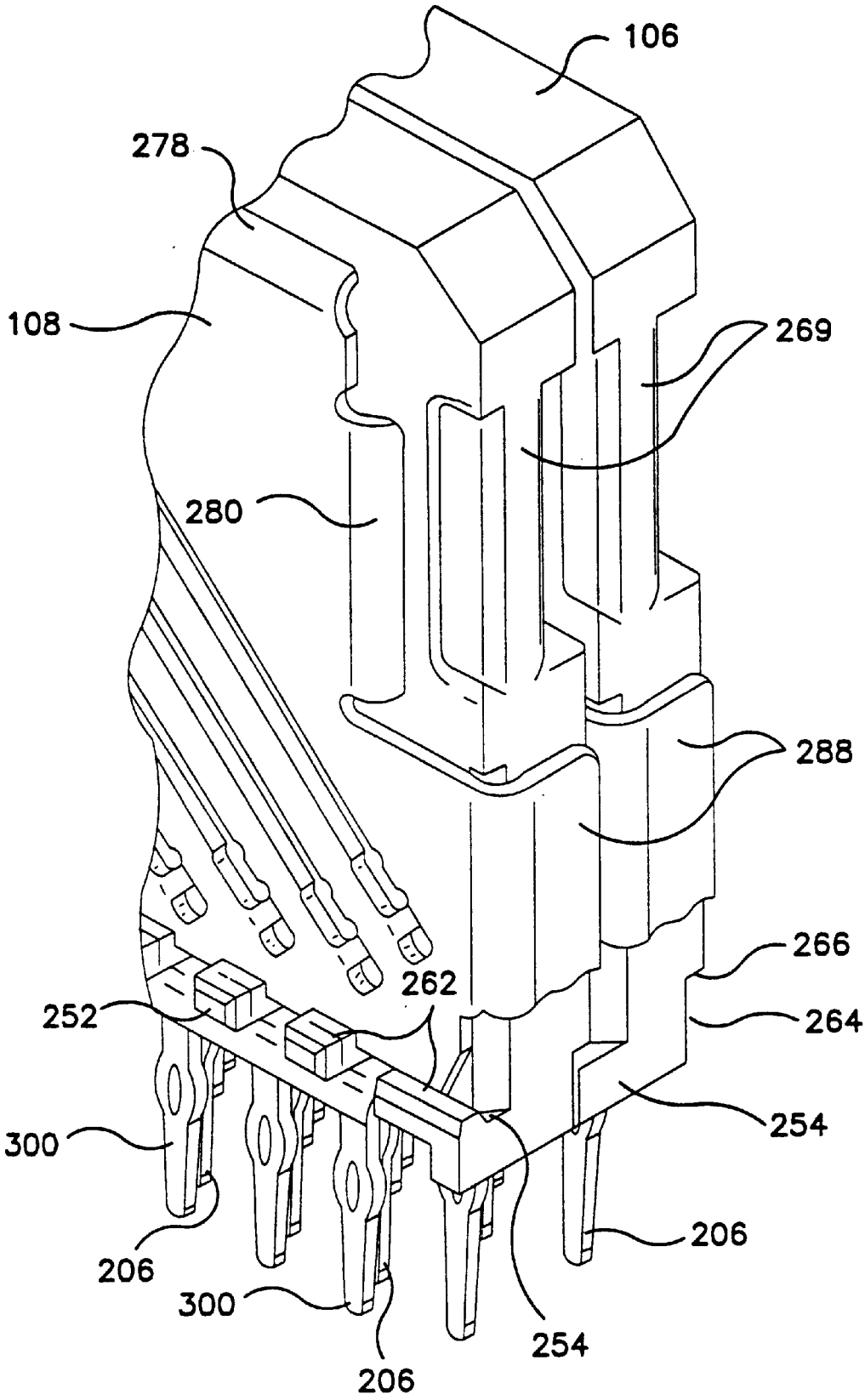
FIG. 9 is an enlarged perspective view showing interlocking of adjacent connector modules, each connector module being formed to include a plurality of tabs on a first side thereof which are received in a cutout formed on the second side of an adjacent connector module to prevent the connector modules from separating when the socket connector is press fitted onto a printed circuit board.

The six small tabs 252 and the two large tabs 254 are each formed to have a raised area 262 around the outer periphery thereof to hold the vertical stripline shields 108 against the associated connector modules 106 to prevent the vertical stripline shields 108 from slipping during press fitting of the socket connector 100 onto a printed circuit board 32. The slipping of the vertical stripline shields 108 may cause the shield tails 276 to roll over or buckle. Likewise, as shown in FIG. 9, the second side 234 of each connector module 106 is formed to include a slot 264 extending along the bottom edge thereof into which the tabs 252 and 254 formed on the first side 232 of the adjacent connector module 106 are received. The downwardly-facing surface 266 of the slot 266 overhangs over the tabs 252 and 254, and exerts a downward force on the upwardly-facing surfaces of the tabs 252 and 254 during press fitting of the socket connector 100 onto a printed circuit board 32 to prevent the connector modules 106 from separating. The separation of the connector modules 106 may cause the pin tails 206 to roll over or buckle. The connector modules 106 are formed to include grip areas 269, which are used to line up the connector modules 106 prior to insertion of the laterally-extending tailshields 110.

Again referring to FIG. 8, the first sides 232 of the connector modules 106 are further formed to include three columns of support bumps 268 near the front, back and the middle of the connector modules 106 between the laterally-extending angled passageways 230 therein. The support bumps 268 define the spacing between the connector modules 106 and the respective vertical stripline shields 108. The laterally-extending angled tailshields 110 inserted in the laterally-extending angled passageways 230 in the connector modules 106 cooperate with the three columns of support bumps 268 to lend rigidity to the socket structure. The support bumps 262 are configured to form air gaps around the conductive paths 202 in the connector modules 106 in an assembled socket connector 100. The geometry and dimensions of the air gaps surrounding the conductive paths 202 and the geometry and dimensions of the insulating and shielding materials surrounding the air gaps are configured to tune the socket connector 100 to match a specified impedance.

Figure 10:
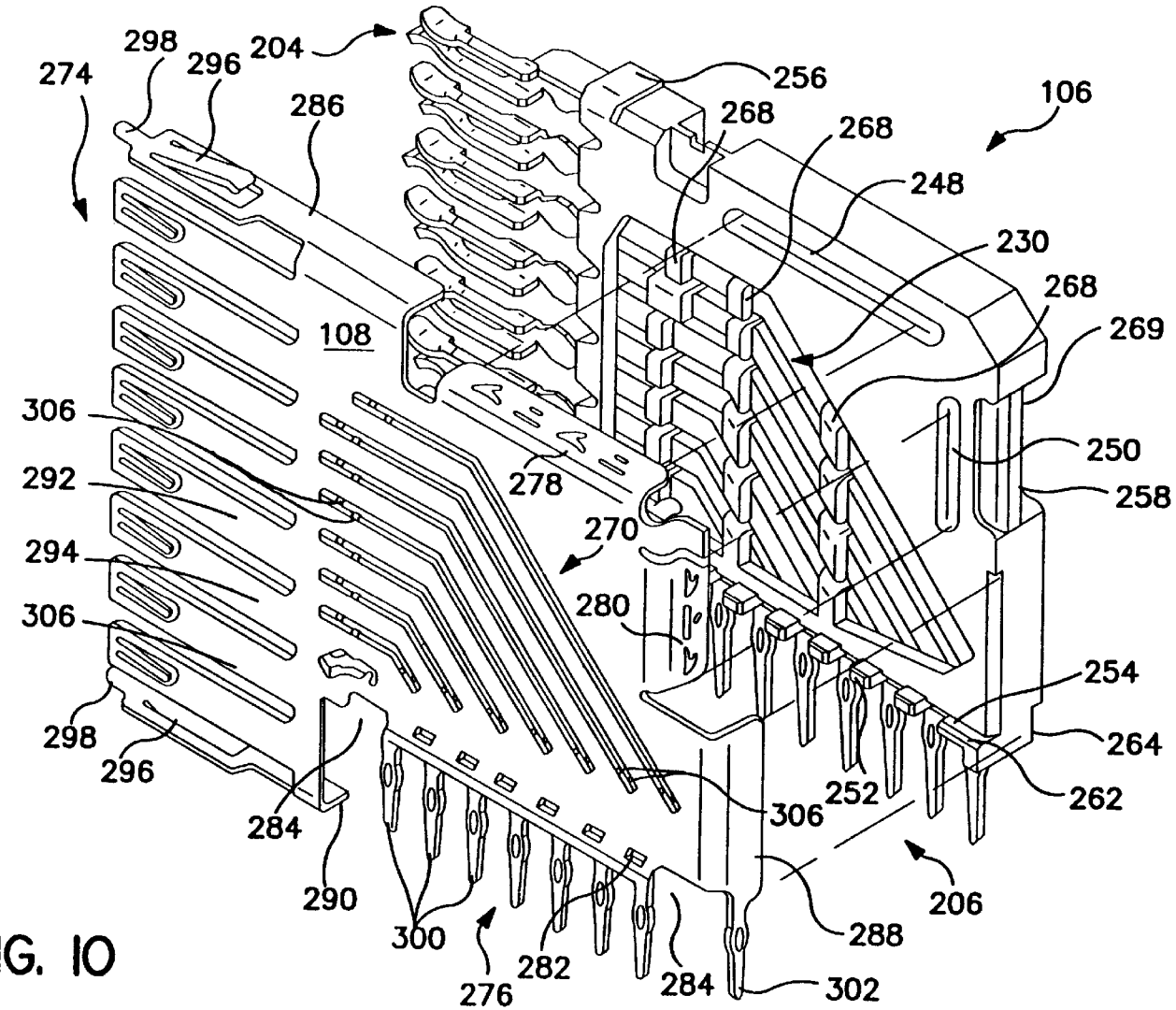
FIG. 10 is a perspective view of one of a plurality of vertical stripline shields configured to be coupled to an associated connector module to form a paired connector unit, each vertical stripline shield including eight forwardly-extending shield fingers to the left of figure each aligned with a forwardly-extending receptacle contact of an associated connector module, eight downwardly-extending shield tails to the bottom right of figure which are disposed adjacent to the downwardly-extending pin tails of the connector module, eight laterally-extending angled passageways configured to be aligned with eight laterally-extending angled passageways in the connector module, six small apertures at the bottom for receiving six small tabs of the connector module, two large slots for receiving two large tabs of the connector module, a horizontal cantilevered flange for extending into the horizontal recess in the connector module, and a vertical cantilevered flange for extending into the vertical recess in the connector module.

FIG. 10 shows one of a plurality of vertical stripline shields 108 configured to be press fitted to an associated connector module 106 to form a paired connector unit 112. As previously indicated, both the vertical stripline shields 108 and the connector modules 106 are formed to include a number of interlocking features that facilitate press fitting of the vertical stripline shield 108 to the connector module 106, and ensure good support and proper alignment of the corresponding elements when the two are press fitted. For example, each vertical strip line shield 108 includes eight angled passageways 270 extending laterally between the opposite sides thereof in substantial alignment with the laterally-extending angled passageways 230 in the connector modules 106, eight forwardly-extending shield fingers 274 in substantial alignment with eight forwardly-extending receptacle contacts 204 of the connector modules 106, eight downwardly-extending shield tails 276 adjacent to eight downwardly-extending pin tails 206 of the connector modules 106, a first horizontal cantilevered top flange 278 configured for reception in the horizontal recess 248 of the connector module 106, a first vertical cantilevered flange 280 configured for reception in the vertical recess 250 of the connector module 106, six small apertures 282 at the bottom for reception of six small tabs 252 of the connector module 106, two large slots 284 at the bottom for reception of two large tabs 254 of the connector module 106, a second horizontal cantilevered top flange 286 which fits over a top wall 256 of the connector module 106, a second vertical cantilevered flange 288 which fits over a back wall 258 of the connector module 106, and a third horizontal cantilevered bottom flange 290 which fits over a bottom wall 260 of the connector module 106.

As shown in FIG. 10, each laterally-extending angled passageway 270 in the vertical stripline shield 108 includes first and second leg portions 292 and 294 substantially aligned with the first and second leg portions 242 and 244 of an associated, laterally-extending angled passageway 230 in the connector module 106 to form laterally-extending angled channels 304 in the paired connector units 112. Each vertical stripline shield 108 is further formed to include two pairs of opposed tabs 306 near the front and back of the vertical stripline shield 108. The opposed tabs 306 project into the laterally-extending angled passageways 270 in the vertical stripline shields 108, and are configured to electrically contact laterally-extending angled tailshields 110 inserted in the laterally-extending angled channels 304 in the paired connector units 112 to fonn a coaxial shield around each conductive path 202.

The top and bottom horizontal cantilevered flanges 286 and 290 of the vertical stripline shield 108 slide over the external surfaces 154 of the top and bottom walls 124 and 126 of the front cap 102. The top and bottom horizontal cantilevered flanges 286 and 290 are formed to include top and bottom contact arms 296 to electrically engage corresponding top and bottom ground pins 408 of the header connector 400 as shown in FIGS. 22 and 23. The top and bottom horizontal cantilevered flanges 286 and 290 are additionally formed to include tabs 298 which are configured to slide into corresponding guide slots 128 in the top and bottom walls 124 and 126 of the front cap 102 to ensure alignment of the vertical stripline shields 208 with the front cap 102. It will be understood that the top and bottom contact arms 296 and the top and bottom tabs 298 of the vertical stripline shields 108 are optional and may be eliminated. As shown in FIG. 11, each group of eight downwardly-extending shield tails 276 is arranged as seven side shield tails 300 and one end shield tail 302 adjacent to a respective one of pin tails 206. The downwardly-extending shield tails 276 of the vertical stripline shields 108 may be press fitted into the holes in a printed circuit board or soldered thereto.

Thus each vertical stripline shield 108 is designed to be press fitted onto a connector module 106 so that the eight laterally-extending angled passageways 270 therein align with the eight laterally-extending angled passageways 230 in the connector modules 106 to form eight laterally-extending angled channels 304, the eight forwardly-extending shield fingers 274 thereof align with the eight forwardly-extending receptacle contacts 204 of the contact circuitry 200, the eight downwardly-extending shield tails 276 therein are disposed adjacent to the eight downwardly-extending pin tails 206 of the contact circuitry 200, the first horizontal cantilevered top flange 278 is inserted into the horizontal recess 248 of the connector module 106, the first vertical cantilevered flange 280 is inserted into the vertical recess 250 of the connector module 106, the six small tabs 252 of the connector module 106 are inserted into the six small apertures 282 in the vertical stripline shield 108, the two large tabs 254 of the connector module 106 are inserted into the two large slots 284 in the vertical stripline shield 108, the second horizontal cantilevered top flange 286 of the vertical stripline shield 108 fits over the top wall 256 of the connector module 106, the second vertical cantilevered flange 288 of the vertical stripline shield 108 fits over the back wall 258 of the connector module 106, and the third horizontal cantilevered bottom flange 290 fits over the bottom wall 260 of the connector module 106.

Figure 12:
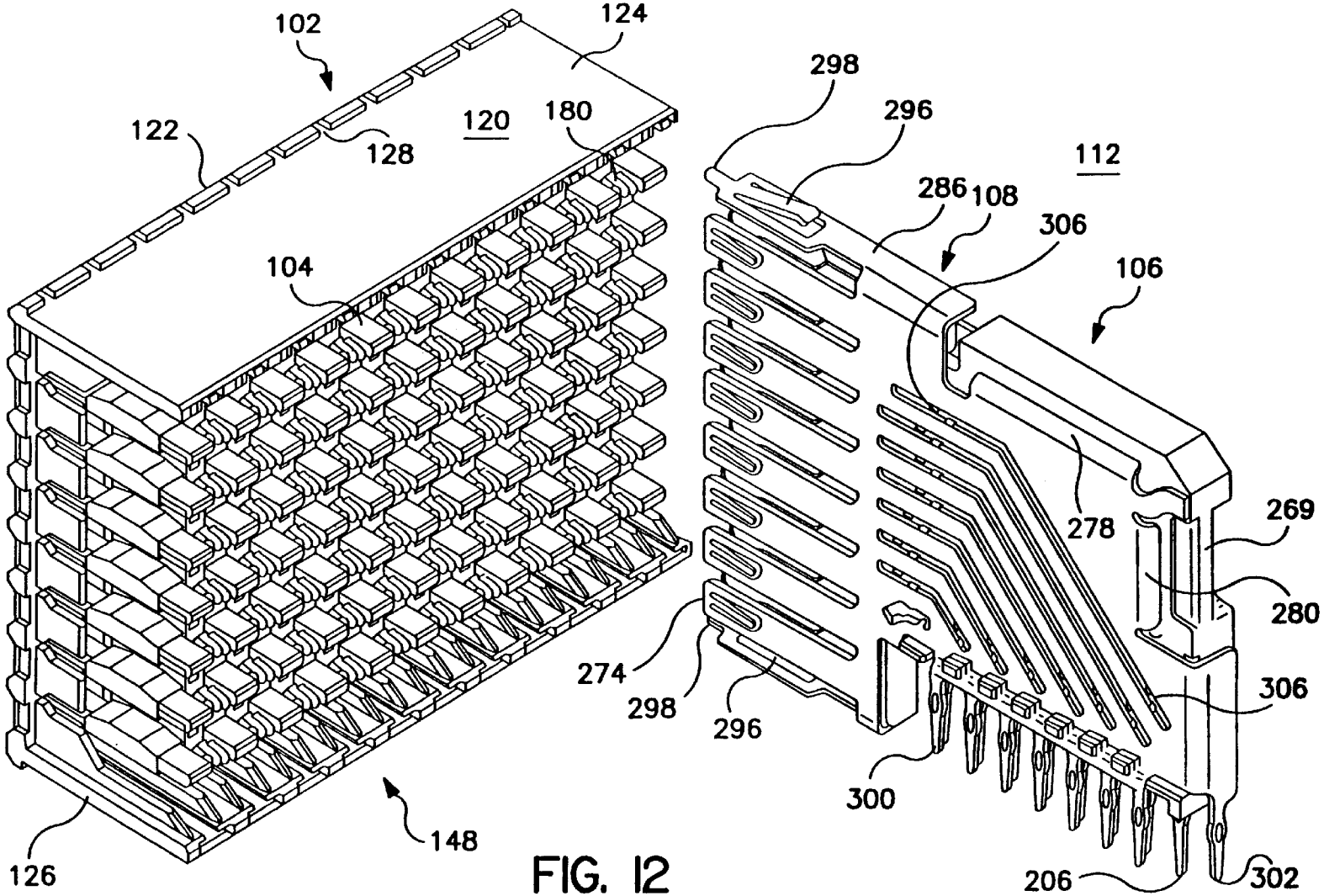
FIG. 12 is a perspective view showing a front cap having seven horizontal shields inserted into the seven laterally-extending slots between the inwardly-extending rectangular vertical dividers in the front wall to form eight horizontally-extending compartments in substantial alignment with eight rows of pin-insertion windows, and further showing a paired connector unit aligned with a pair of guide slots formed in the top and bottom walls of the front cap, the vertical dividers horizontally separating the forwardly-extending receptacle contacts of the connector modules from each other and from the forwardly-extending shield fingers of the vertical stripline shields, the horizontal shields vertically separating the eight forwardly-extending receptacle contacts and the eight forwardly-extending shield fingers from each other, the flexible contacts at the front and back of the horizontal shields contacting the forwardly-extending shield fingers of the vertical stripline shield to form a coaxial shield around each receptacle contact.
Figure 13:
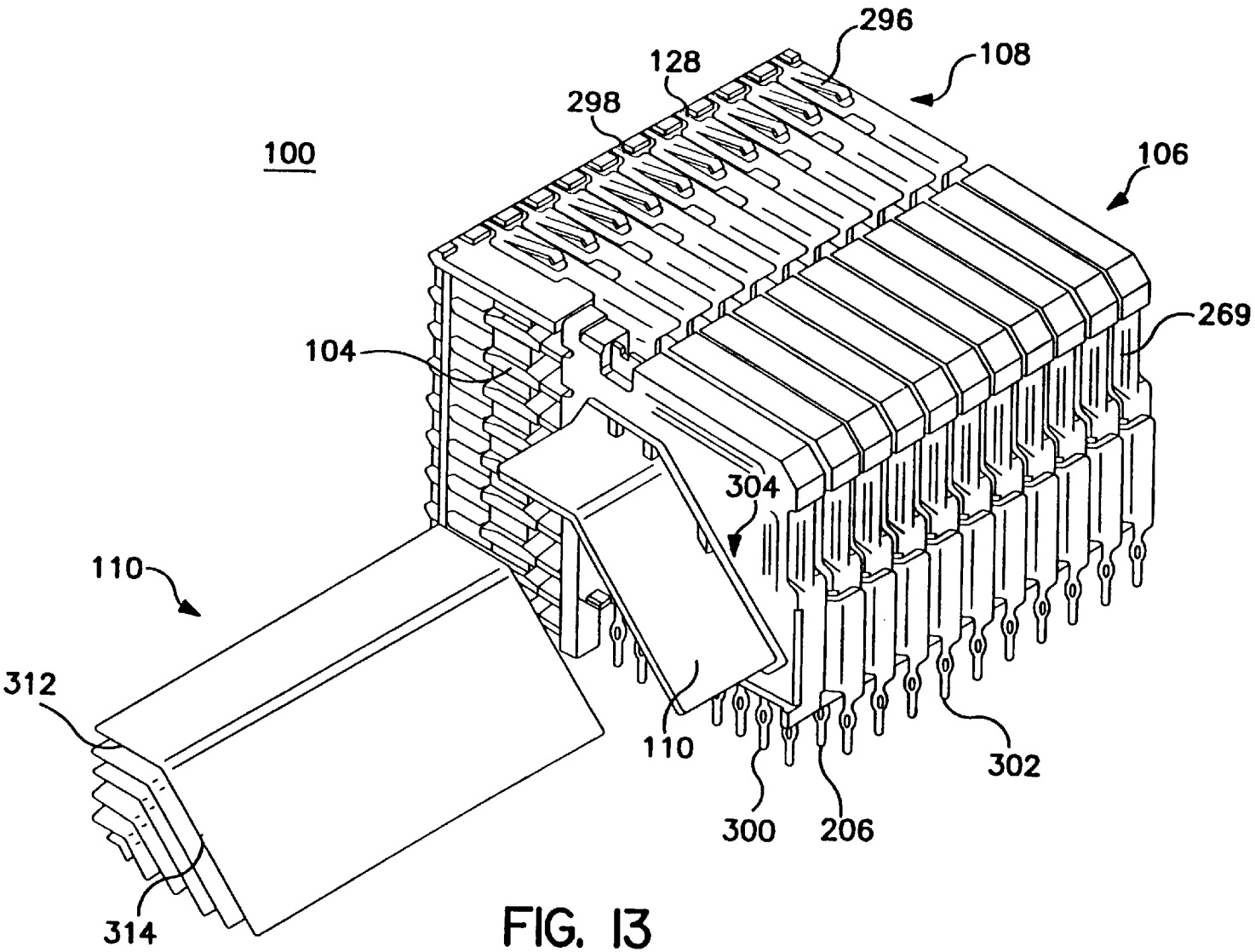
FIG. 13 is a perspective view showing a partially assembled socket connector to the right of figure, and further showing eight laterally-extending angled tailshields to the left of figure positioned for insertion into eight laterally-extending angled channels in the connector modules and vertical stripline shields, the vertical stripline shields having two pairs of opposed tabs projecting into the laterally-extending angled passageways therein for electrically contacting the laterally-extending tailshields to form a coaxial shield around each conductive path.
Figure 14:
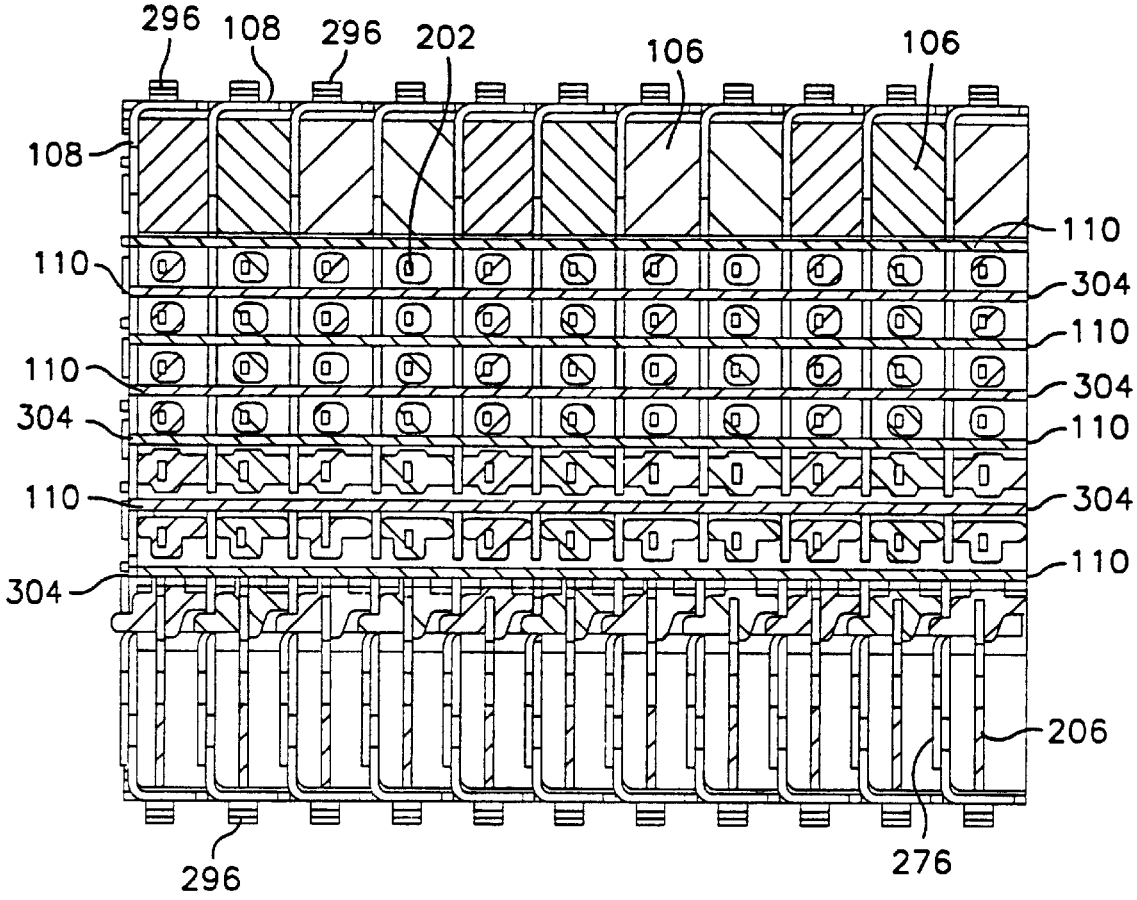
FIG. 14 is a cross-sectional view showing horizontal tailshields inserted into the laterally-extending angled channels across the connector modules and the vertical stripline shields to form a coaxial shield around each conductive path.

FIGS. 12 shows seven horizontal shields 104 inserted into seven laterally-extending slots 146 in the front cap 102 to form eight laterally-extending compartments 148 in substantial alignment with eight rows of pin-insertion windows 130 therein, and further shows one oaf plurality of paired connector units 112 positioned for insertion into the front cap 102. As shown therein, the internal surfaces of the top and bottom walls 124 and 126 of the front cap 102 include a narrower guide slot 158 for guiding insertion of a vertical stripline shield 108 and a broader guide slot 160 for guiding insertion of an associated connector module 106. As shown in FIGS. 13 and 14, the laterally-extending angled passageways 230 and 270 in the connector modules 106 and the vertical stripline shields 108 are aligned with each other to form a plurality of laterally-extending angled channels 304 extending side-to-side between the opposite sides of the socket connector 100. The vertical dividers 140 in the front cap 102 horizontally separate the forwardly-extending receptacle contacts 204 of the connector modules 106 from each other and from the forwardly-extending shield fingers 274 of the associated vertical stripline shields 108. The horizontal shields 104, on the other hand, vertically separate the eight forwardly-extending receptacle contacts 204 and the eight forwardly-extending shield fingers 274 from each other. The flexible contacts 180 of the horizontal shields 104 electrically contact the forwardly-extending shield fingers 274 of the vertical stripline shields 108 to form a coaxial shield around each receptacle contact 204. The use of two flexible contacts 180 at the front and back of the horizontal shields 104 serves to distribute the ground currents radially around the receptacle contacts 204, thereby reducing the crosstalk between neighboring signals.

FIG. 13 shows eight laterally-extending angled tailshields 110 positioned for insertion into the eight laterally-extending angled channels 304 in the socket connector 100. Each laterally-extending angled tailshield 110 is formed to include first and second leg portions 312 and 314 substantially aligned with the first and second leg portions 292 and 294 of the vertical stripline shields 108. The opposed tabs 306 of the eight vertical stripline shields 108 electrically contact the laterally-extending angled tailshields 110 inserted into the eight laterally-extending angled channels 304 to form a coaxial shield around each conductive path 202 as more clearly shown in FIG. 14. As previously indicated, the use of two pairs of opposed tabs 306 near the front and back of the vertical stripline shield 108 serves to distribute the ground currents radially around the conductive paths 202, thereby reducing the crosstalk between neighboring signals. The laterally-extending angled tailshields 110 may be formed instead by plating the laterally extending passageways 230 in the connector modules 106.

Figure 15:
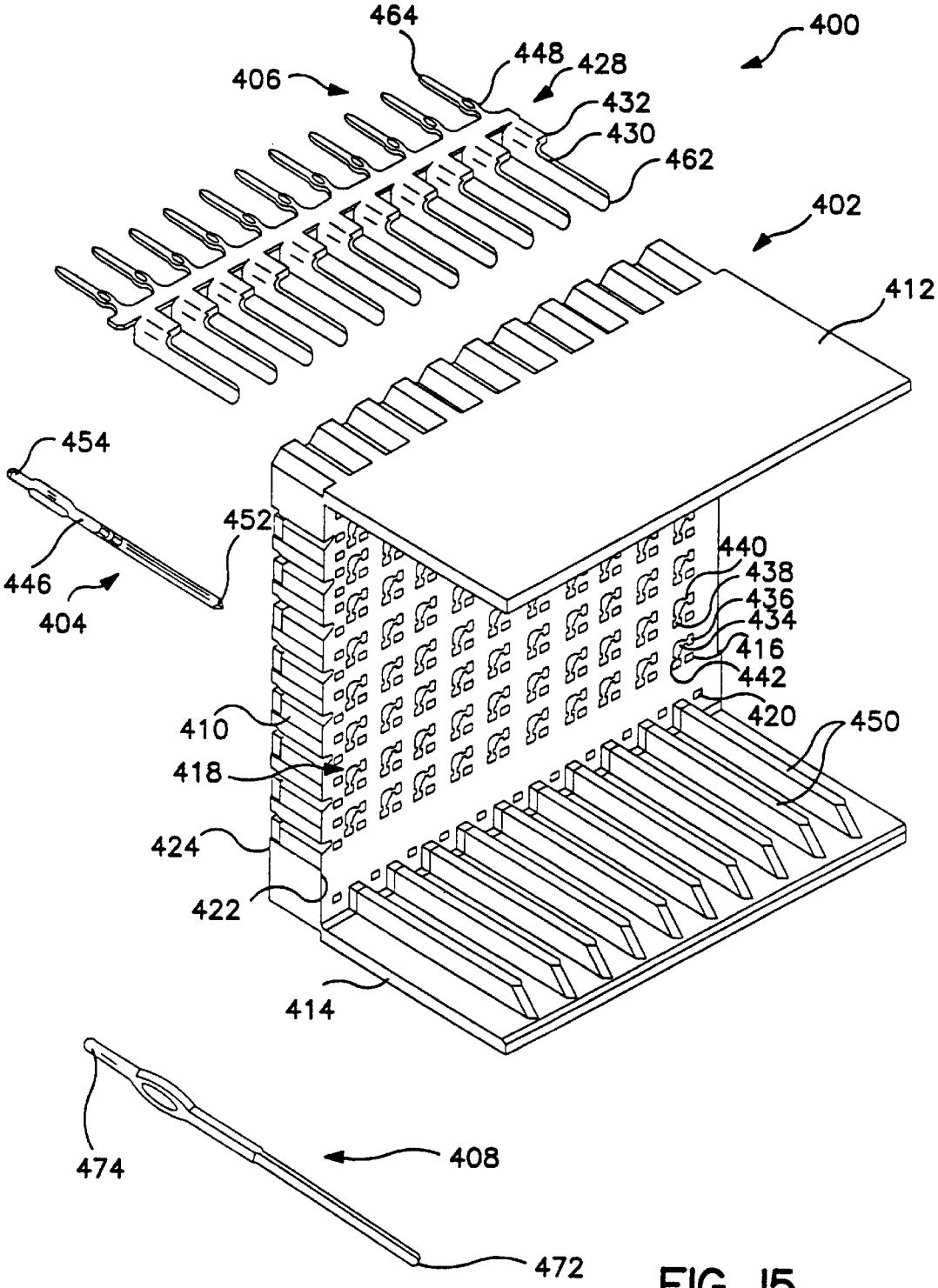
FIG. 15 is an exploded perspective view of the header connector of FIG. 1 according to another aspect of the present invention, and showing a signal pin, a continuous strip of shield blades, a ground pin and a header body, the header body including a front wall, top and bottom laterally-extending walls extending perpendicularly from the front wall, and a plurality of first, second and third openings in the front wall for receiving a plurality of signal pins, shield blades and ground pins therein.
Figure 15A:
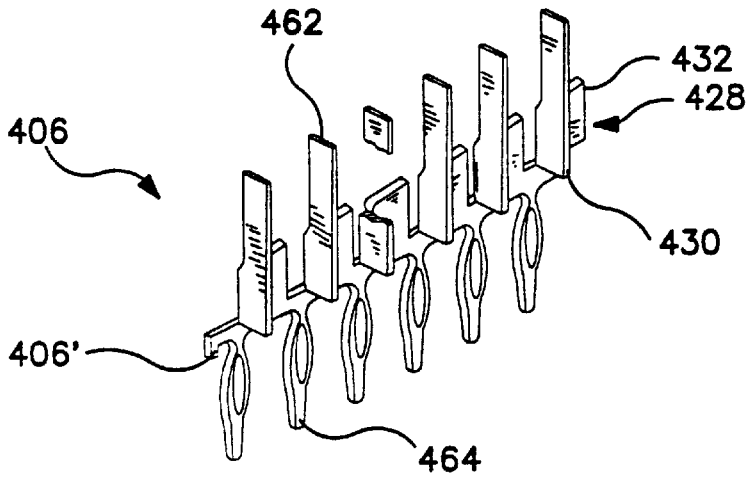
FIG. 15*a* is a perspective view of the continuous strip of shield blades 406 of FIG. 15.
Figure 16:
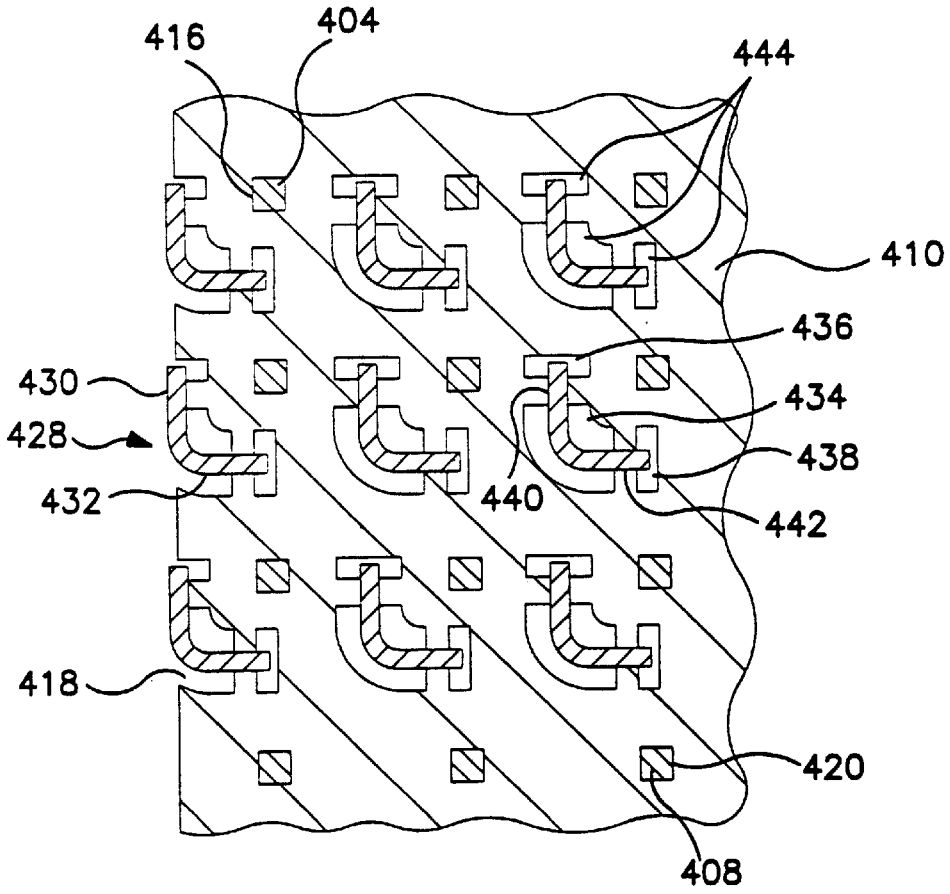
FIG. 16 is a cross-sectional view of the front wall of the header connector showing signal pins surrounded by right angle portions of the shield blades forming coaxial shields around each signal pin.

FIGS. 15, 15*a* and 16 show the header connector 400 in accordance with another aspect of the present invention. The header connector 400 includes a header body 402, a plurality of signal pins 404, a continuous strip having a plurality of shield blades 406 formed therein, and a plurality of ground pins 408. Except for their length, the ground pins 408 are substantially identical to the signal pins 404. The header body 402 is formed to include a vertical front wall 410, and top and bottom laterally-extending, horizontal walls 412 and 414 projecting perpendicularly therefrom. The front wall 410 is formed to include a plurality of first signal-pin-receiving openings 416, a plurality of second shield-blade-receiving openings 418, and a plurality of third ground-pin-receiving openings 420, all of which extend between the internal and external surfaces 422 and 424 thereof. The plurality of second shield-blade-receiving openings 418 are formed to have a generally right angle cross-section.

The plurality of signal pins 404 are configured for insertion into the plurality of first signal-pin-receiving openings 416 in the header connector 400 to form an array of pin contacts 426 (shown in FIG. 1) which are configured for reception in an array of pin-insertion windows 130 in the socket connector 100, when the socket connector 100 is inserted into the header connector 400. Each signal pin 404 includes a first end 452 extending above the front wall 410 of the header connector 400, and a second end 454 spaced apart from the first end 452 and configured for insertion into an opening 36 in a printed circuit board 34.

The plurality of shield blades 406 are formed to include a generally right angle shielding portion 428 configured to be inserted into the plurality of second, generally right angle shield-blade-receiving openings 418. Each shield blade 406 includes a first end 462 extending above the front wall 410 of the header connector 400 adjacent to the first end 452 of a signal pin 404, and a second end 464 spaced apart from the first end 462 configured for insertion into a hole 38 in the printed circuit board 34 adjacent to the second end 454 of the signal pin 404. As shown in FIG. 15*a*, the generally right angle shielding portion 428 of each of the plurality of shield blades 406 includes substantially perpendicular first and second leg portions 430 and 432.

As shown in FIG. 16, the first signal-pin-receiving openings 416 and the second shield-blade-receiving openings 418 are arranged symmetrically in the front wall 410 of the header body 402 such that the generally right angle shielding portions 428 of shield blades 406 substantially surround the signal pins 404 to form a coaxial shield around each of the plurality of signal pins 404. Each of the plurality of second, generally right angle shield-blade-receiving openings 418 includes a central portion 434 coupled to first and second end portions 436 and 438 by first and second narrowed throat portions 440 and 442. The first and second narrowed throat portions 440 and 442 are dimensioned to frictionally engage the first and second leg portions 430 and 432 of the shield blades 406 to hold the shield blades 406 in place. The central portion 434 and the first and second end portions 436 and 438 of each of the plurality of second generally right angle openings 418 are formed to provide air gaps 444 surrounding the generally right angle shielding portion 428 of a shield blade 406. The geometry and dimensions of the air gaps 444, the geometry, dimensions and material of the right angle shielding portions 428, and the geometry, dimensions and material of the header body 402 surrounding the air gaps 444 are configured to tune the header connector 400 to match a specified impedance (for example, 50 ohms). The configuration of the right angle shield blades 406 lends itself to mass production in a continuous strip in a manner that economizes material usage.

A plurality of ground pins 408 are configured for insertion into the plurality of third ground-pin-receiving openings 420 in the front wall 410 of the header connector 400. The plurality of ground pins 408 are configured to engage contact arms 296 of the corresponding vertical stripline shields 108 when the socket connector 400 is inserted into the header connector 100 as shown in FIGS. 22 and 23. Each ground pin 408 includes a first end 472 extending above the front wall 410 of the header connector 400, and a second end 474 spaced apart from the first end 472 and configured for insertion into a hole 40 in a printed circuit board 34.

Each of a plurality of signal pins 404 includes a pin tail 446, and each of the plurality of shield blades 406 includes a shield tail 448. When the signal pins 404 and shield blades 406 are inserted into the front wall 410 of the header body 402, the pin tails 446 and the shield tails 448 extend outwardly from the external surface 424 of the front wall 410 such that each shield tail 448 is located adjacent to a pin tail 446.

Figure 17:
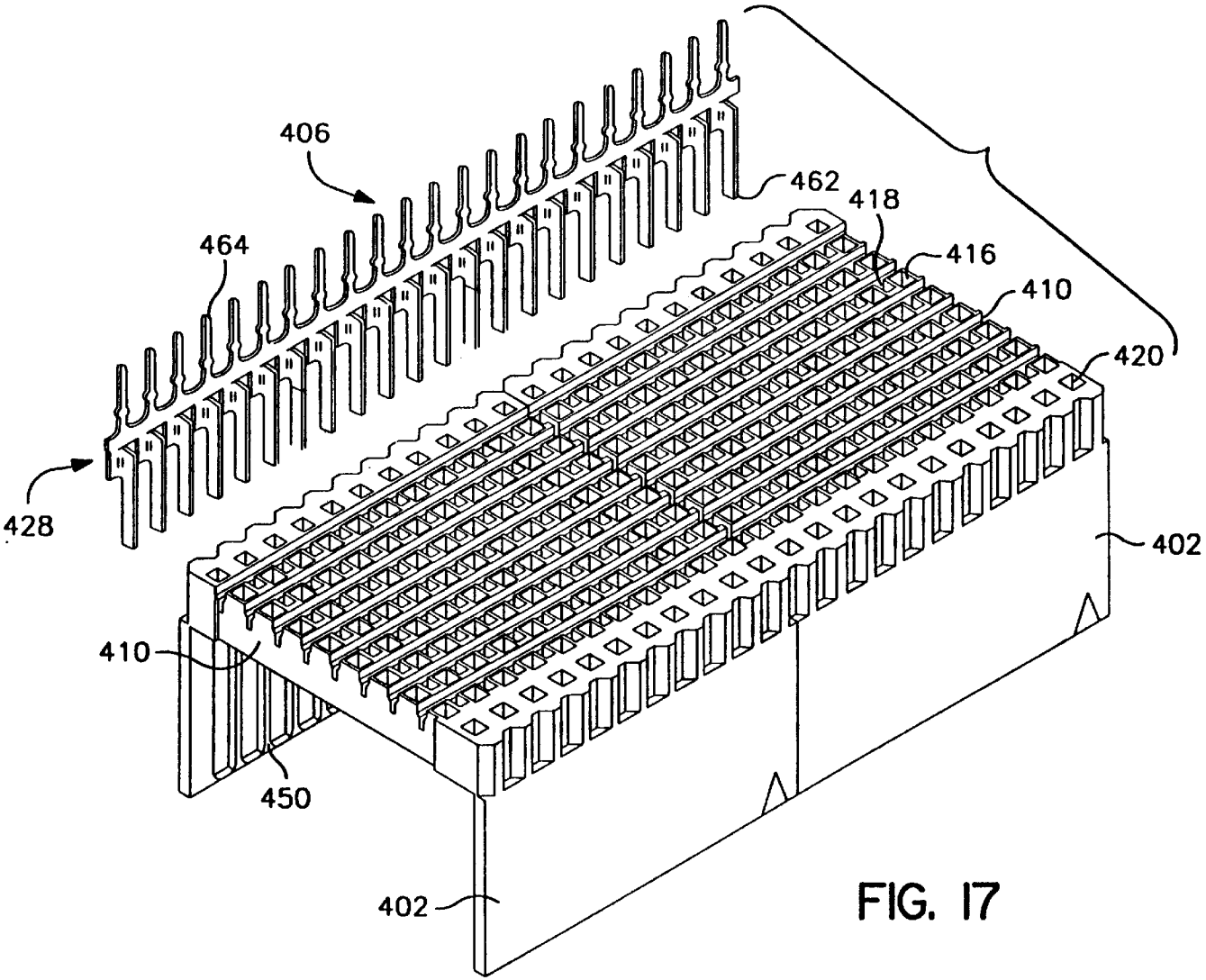
FIG. 17 is a perspective view showing two header bodies positioned end to end, and a strip of shield blades extending across the two header bodies, the strip of the header blades being configured to be inserted into the two header bodies to connect them together to form a monoblock.
Figure 18:
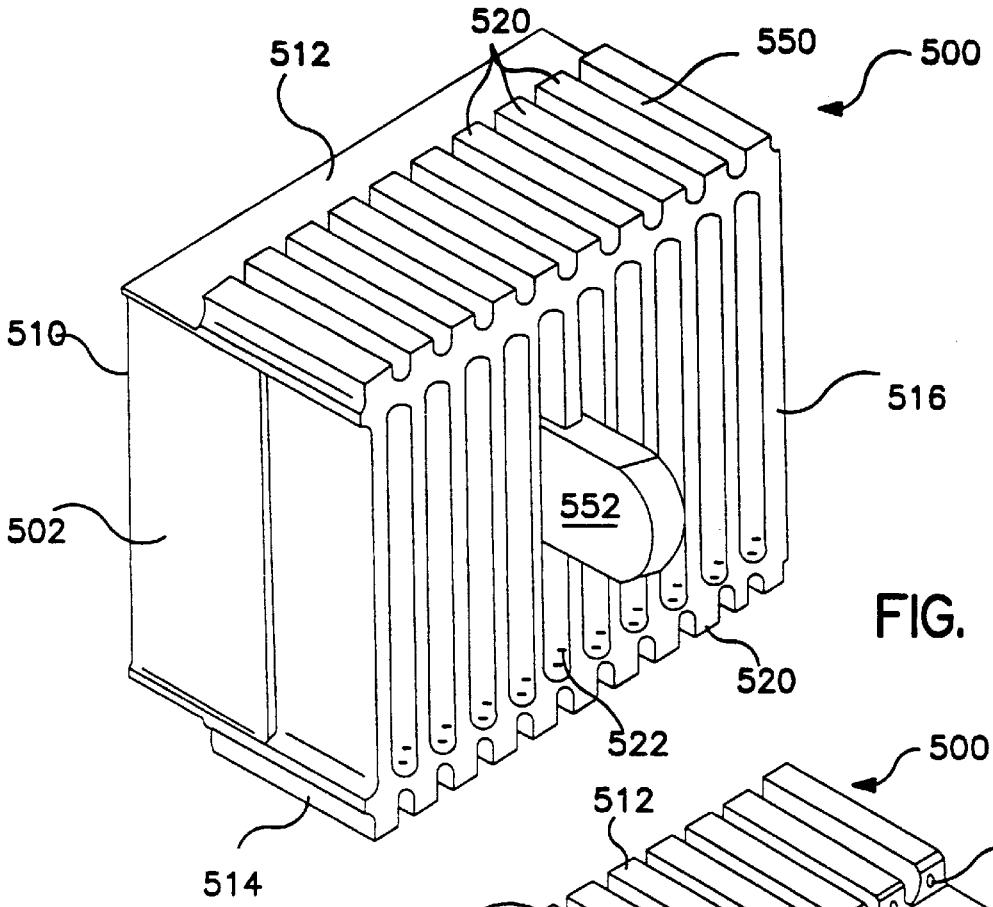
FIG. 18 is a perspective view of a protective cap in accordance with still another aspect of the present invention, the protective cap protecting the signal pins, the shield blades and the ground pins of the header connector during shipping and handling of the header connector to a customer's facility and also serving to aid the installation of the header connector onto a printed circuit board at the customer's facility.
Figure 19:
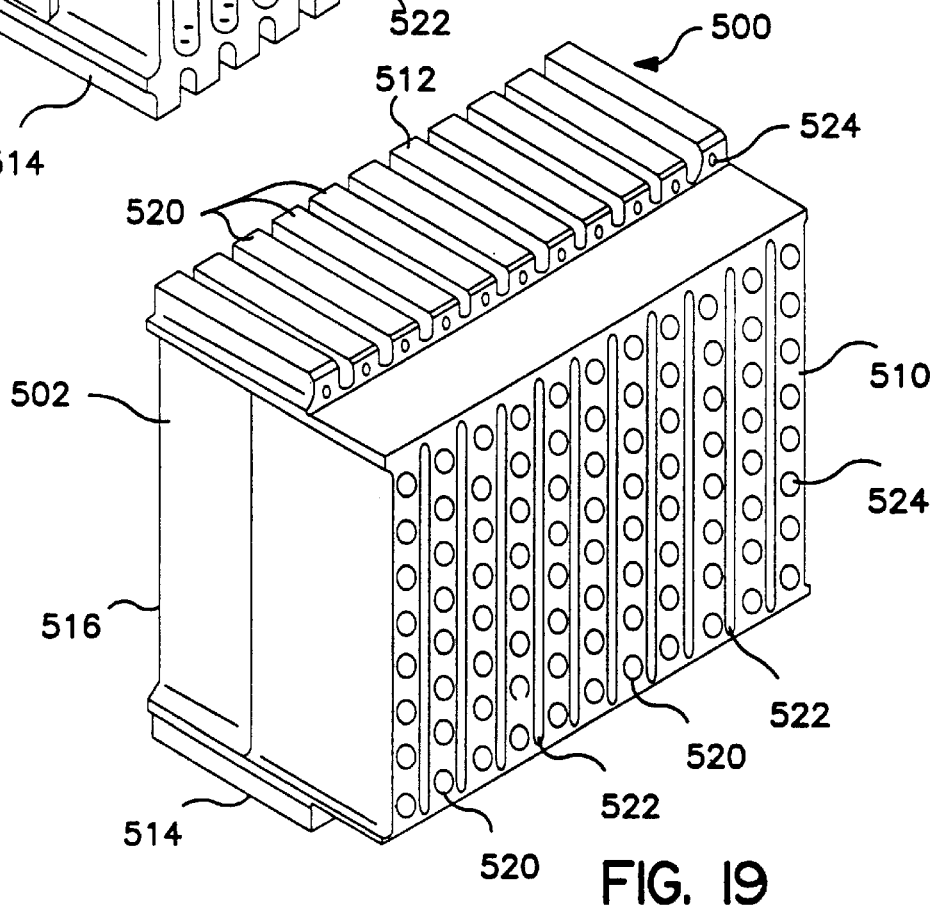
FIG. 19 is a perspective view of the protective cap of FIG. 17, turned 180 degrees from the position shown in FIG. 17 to show a plurality of ribs formed in the front wall thereof, a plurality of slots for receiving the shield blades of the header connector and a plurality of holes formed in the ribs for receiving the signal pins and the ground pins of the header connector.

FIG. 17 is a perspective view showing first and second header bodies 402 positioned end to end, and one of a plurality of continuous strips of shield blades 406 configured for insertion into a row of shield-blade-receiving openings 418 in the first and second header bodies 402. The continuous strips of shield blades 406 extend between the first and second header bodies 402 to tie them together to form a monoblock. The continuous strips of shield blades 406 can be used to connect any number of header connectors 400 to create header connectors of variable length. As shown in FIG. 15*a*, the strip of shield blades 406 may be formed to include a right angle tab 406' at opposite ends thereof to provide a secure connection between the header bodies 402. Monoblocking can also be used on the socket side of the connectors. For example, the horizontal tailshields 110 can extend between several adjoining socket housings 120 to couple them together.

It is known to provide metal application or termination tools (not shown) to install a header connector 400 onto a printed circuit board at a customer's facility. These termination tools are typically made of steel, and include a bottom wall formed to include an array of holes for receiving the signal pins 404, shield blades 406 and ground pins 408 of the header connector 400 therein. The termination tools are used to install the header connector 400 onto a printed circuit board 34 at a customer's facility by pushing on the ends of the signal and ground pins 404 and 408 or on shoulders thereof The holes in these termination tools may be formed at different depths to set the signal and ground pins 404 and 408 at different heights in the installed header connector 400. Illustratively, the difference in heights could be about $^{30}/_{1,000}$ inches. Different height signal pins 404 are desirable for sequencing the circuits on the printed circuit board, for example, to power some circuits ahead of others. These conventional termination tools are typically precision-machined metal parts, and are relatively expensive.

FIGS. 18–21 show a relatively inexpensive plastic protective cap 500 in accordance with still another aspect of the present invention, which doubles as a termination tool. The protective cap 500 protects the signal pins 404, the shield blades 406 and the ground pins 408 of the header connector 400 during shipping and handling of the header connector 400 until a socket connector 100 is plugged into the header connector 400 at a customer's facility, at which time the protective cap 500 may be removed from the header connector 400. At the customer's facility, the protective cap 500 is used to install the header connector 400 onto a printed circuit board 34 without the need for any additional application or termination tooling. The protective cap 500 includes a body 502 having a front wall 510, a top wall 512, a bottom wall 514 and back wall 516. The cap body 502 is formed to include a plurality of ribs 520 that extend between the front and back walls 510 and 516 thereof to define a plurality of through slots 522 therein. The slots 522 are configured to receive the planar first ends 462 of the shield blades 406 when the protective cap 500 is inserted into the header body 400. The ribs 520 are, in turn, formed to include a plurality of holes 524 therein configured to receive the first ends 452 and 472 of the signal pins 404 and the ground pins 408.

The external surfaces of the top and bottom walls 512 and 514 are formed to include a plurality of guide grooves 550 which are configured to engage corresponding plurality of guide portions 450 formed on the internal surfaces of the top and bottom walls 412 and 414 of the header connector 400 when the protective cap 500 is inserted into the header connector 400. The engagement between the guide grooves 550 in the protective cap 500 and the guide portions 450 in the header connector 400 serve to align the shield-blade-receiving slots 522 in the protective cap 500 with the shield blades 406 in the header connector 400, and the signal and ground pin-receiving holes 524 in the protective cap 500 with the signal and ground pins 404 and 408 in the header connector 400.

Figure 20:
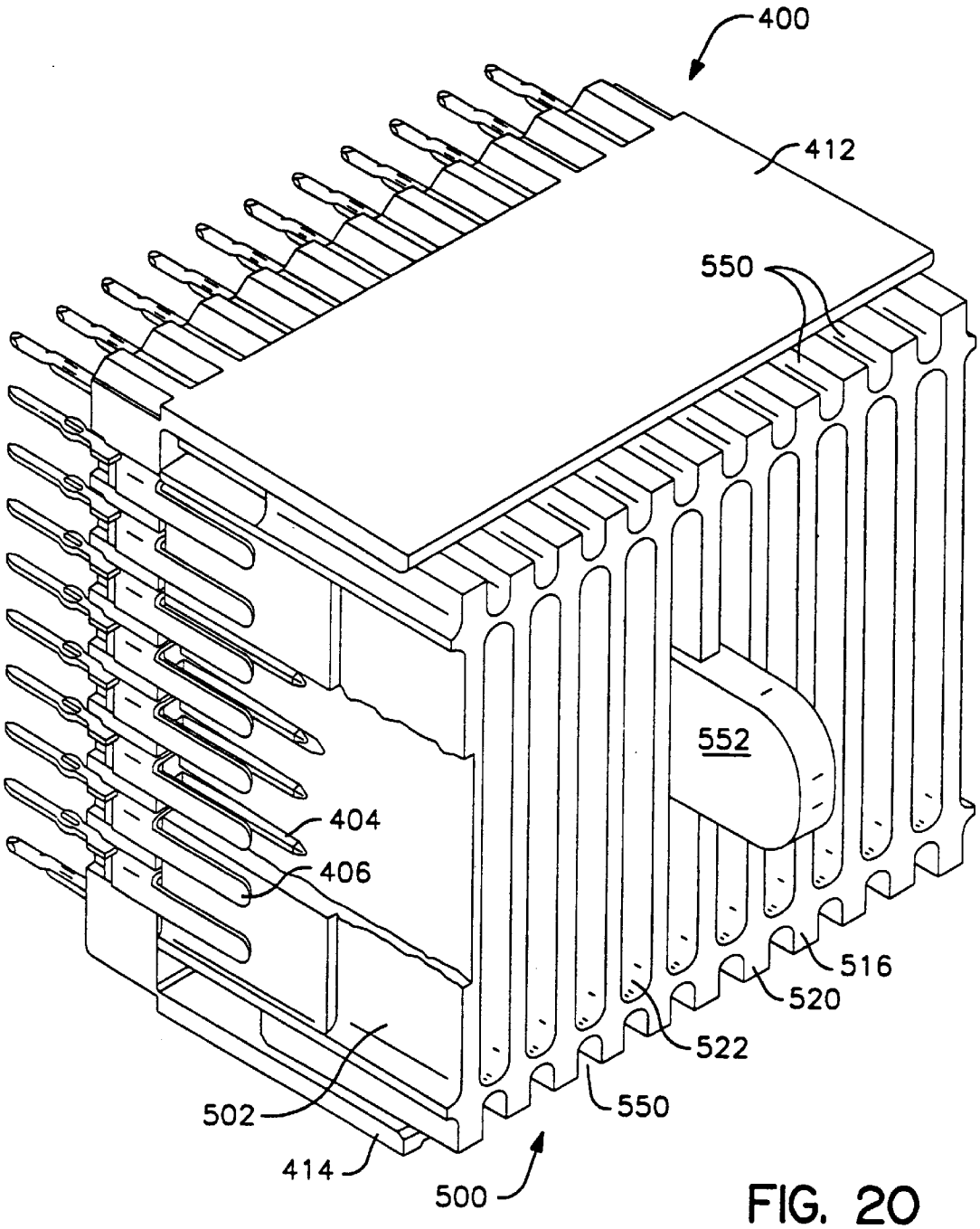
FIG. 20 is a perspective view showing the protective cap of FIGS. 18 and 19 inserted into the header connector, the protective cap being partially broken away on one side to show the signal pins and the shield blades of the header connector.
Figure 21:
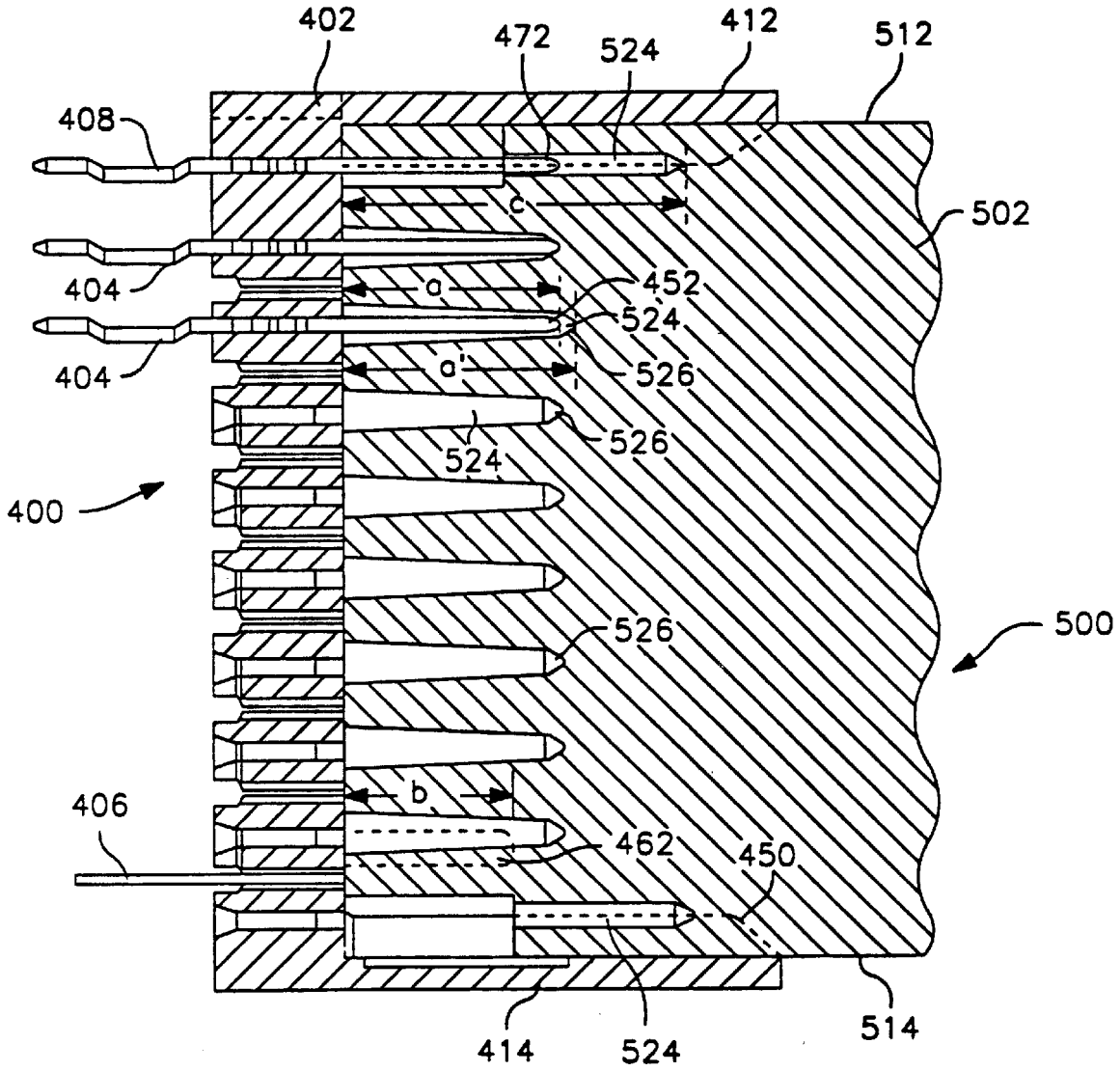
FIG. 21 shows a cross-sectional view of the protective cap of FIGS. 18–20 showing signal pins, shield blades and ground pins of the header connector inserted into the holes and slots in the protective cap.

The header connector 400 is shipped to a customer's facility with a protective cap 500 in place. As previously indicated, the protective cap 500 protects the signal pins 404, the shield blades 406 and the ground pins 408 during shipping and handling of the protective cap 500 to a customer's facility. Additionally, the protective cap 500 doubles as an application or termination tool to press fit the header connector 400 onto a printed circuit board 34. As shown in FIGS. 20 and 21, the holes 524 molded in the ribs 530 in the protective cap 500 may be formed to vary in depths to allow the signal pins 404 and the ground pins 408 to float up during press fitting the header connector 400 onto a printed circuit board 34. This is possible because the force generated by press fitting the header connector 400 onto a printed circuit board 34 is larger than the force required to move the signal pins 404 and the ground pins 408 in the header body 402. The signal pins 404 and the ground pins 408 in the header body 402 move up in the header body 402 until the ends 452 and 472 of the signal pins 404 and the ground pins 408 engage the end surfaces 526 of the holes 524 in the protective cap 500.

In the illustrated embodiment, the end surfaces 526 of the holes 524 in the protective cap 500 push on the ends 452 and 472 of the signal and ground pins 404 and 408 during press fitting of the header connector 400 onto a printed circuit board 34. Alternately, it is possible to provide shoulders on the signal and ground pins 404 and 408, and push on the shoulders instead. Pushing on the ends 452 and 472 of the signal and ground pins 404 and 408 of the header connector 400 during assembly of the header connector 400, instead of shoulders thereof, is particularly desirable for high density connectors because the shoulderless signal and ground pins 404 and 408 occupy smaller space, and can be placed in closer proximity to each other.

The back wall 516 of the protective cap is formed to include a tab 552 that is used for removing the protective cap 500 from the header connector 400 prior to insertion of a socket connector 100 therein. The protective cap 500 is molded from relatively inexpensive thermoplastic material. The thermoplastic material is soft enough so that the ends 452 and 472 of the signal and ground pins 404 and 408 will not be damaged during installation of the header connector 400 onto a printed circuit board 34. On the other hand, the thermoplastic material is not too soft to allow the ends 452 and 472 to puncture the walls of the protective cap 500 more than a few thousands of an inch.

Figure 14A:
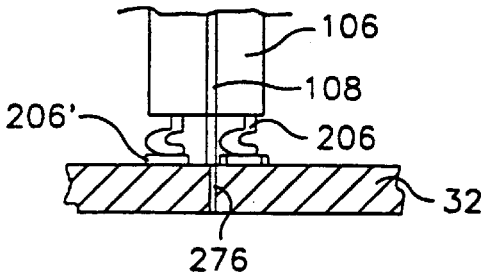
FIG. 14*a* is a cross-sectional view showing surface mounting of the pin tails of the socket connector to a printed circuit board, alternatively—the pin tails may be press fitted into the holes in the printed circuit board or soldered thereto.

FIGS. 23 and 24 show assembly of the socket connector 100 with the header connector 400. External guide means such as card guides or guide pins (not shown) are provided on the opposite sides of the header connector 400 to guide the insertion of the socket connector 100 into the header connector 400—so that the array of pin-insertion windows 130 in the socket connector 100 are aligned with the array of pin contacts 426 in the header connector 400 prior to insertion of the pin contacts 426 into the receptacle contacts 204 of the socket connector 100. As the socket connector 100 is inserted into the header connector 400, the shield blades 406 of the header connector 400 contact corresponding shield fingers 274 of the socket connector 100, and the ground pins 408 of the header connector 400 contact corresponding contact arms 296 of the vertical stripline shields 106. The pin tails 206 and shield tails 276 of the socket connector 100 and the pin tails 446 and shield tails 448 of the header connector 400 can be either press fitted into the holes in the printed circuit boards or soldered thereto. Alternatively, as shown in FIG. 14*a*, the pin tails 206 and 446 and shield tails 276 and 448 could instead be surface mounted to the printed circuit boards.

Thus, the vertical stripline shields 108 (sometimes referred to herein as "first shields" or "first shield portions") cooperate with the laterally-extending tailshields 110 (sometimes referred to herein as "second shields" or "second shield portions") inserted into the laterally-extending angled channels 304 in the socket connector 100 to form a coaxial shield around each conductive path 202. The vertical stripline shields 108 further cooperate with the horizontal shields 104 (sometimes referred to herein as "third shields") to form a coaxial shield around each receptacle contact 204 of the socket connector 100. In addition, the generally right angle shield blades 406 of the header connector 400 substantially surround the signal pins 404 of the header connector 400 to form a coaxial shield around each of the plurality of signal pins 404.

The connector materials, geometry and dimensions are all designed to maintain a specified impedance throughout the part.

The socket connector 100 of the present invention can be reconfigured to form differential pairs in columns and rows. For example, every other vertical stripline shield 108 can be removed in the socket connector 100 to form differential pairs in rows. Likewise, every other horizontal shield 104 and every other tailshield 110 can be removed in the socket connector 100 to form differential pairs in columns.

As previously indicated, additional connections can be made simply by increasing the number of connector modules 106 inserted into the front cap 102. Although the illustrated connector assembly 30 is designed to make connections which are a multiple of eight (8), it will be noted that the connector assembly 30 in accordance with the present invention may very well be designed to make connections which are a multiple of a number other than eight (8).

The design of the illustrated connector assembly 30 lends itself to the creation of connectors which are of a variable length. The continuous strips of shield blades 406 can be used to connect any number of header connectors 400 to create header connectors of variable length. Monoblocking can also be used on the socket side of the connectors. For example, the horizontal tailshields 110 can extend between several adjoining socket housings 120 to couple them together.

All plastic parts are molded from suitable thermoplastic material—such as liquid crystal polymer ("LCP"). The protective cap 500 may be molded from nylon. The metallic parts are made from plated copper alloy material.

Although the invention has been described in detail with reference to certain preferred embodiments, variations and modifications exist within the scope and spirit of the invention as described and defined in the following claims.

What is claimed is:

1. A modular socket connector comprising:

a first socket housing, a second socket housing configured to be placed alongside the first socket housing in a side-by-side relationship, a plurality of connector modules configured for insertion into the first and second socket housings, each connector module being formed to include a plurality of laterally-extending through passageways, a plurality of vertical shields configured for insertion into the first and second socket housings, each vertical shield being formed to include a plurality of laterally-extending through passageways in substantial alignment with the laterally-extending through passageways in the connector modules, and a plurality of horizontal shields configured to be inserted into the plurality of laterally-extending through passageways in the plurality of connector modules and first shields inserted in the first and second socket housings placed in a side-by-side relationship, the horizontal shields extending between the first and second socket housings to couple the first and second socket housings together.

2. A removable protective cap for use with a header connector including a header body having a front wall and a back wall and formed to include a plurality of first openings therethrough configured for receiving a plurality of signal pins therein, each signal pin having a first end extending from the front wall of the header body and a second end spaced apart from the first end and extending from the back wall of the header body and configured for insertion into an opening in a printed circuit board, the removable protective cap including a front wall formed to include a plurality of blind holes configured to receive the first ends of the signal pins when the protective cap is inserted into the header body to protect the signal pins during shipping and handling of the header connector, the protective cap including a surface configured to engage a portion of the header body surrounding the signal pins, and the blind holes including a surface configured to engage a portion of the signal pins to permit the protective cap to be used as a termination toll to install the header connector on the printed circuit board, the protective cap being configured to be separated from the header connector upon installation of the header connector on the printed circuit board.

3. The protective cap of claim 2, wherein the protective cap is inserted into the header body to protect the signal pins during shipping and handling of the header connector to a customer's facility, and to further protect the signal pins until a socket connector is inserted into the header connector.

4. The protective cap of claim 3, wherein selected ones of the plurality of holes in the protective cap terminate in an end surface which is configured for engaging the first ends of selected ones of the plurality of signal pins inserted therein when the second ends of said selected ones of the signal pins are pushed into the openings in the printed circuit board during installation of the header connector on the printed circuit board to set the heights of said selected ones of the plurality of signal pins in the installed header connector above the front wall thereof.

5. An electrical header connector comprising:

a header body formed to include a front wall, a back wall, and a plurality of first and second openings extending through the header body to provide a passageway through the front and back walls, a plurality of signal pins configured for insertion into the plurality of first openings, each signal pin including a first end extending from the front wall of the header body to form an array of pin contacts, and a second end spaced apart from the first end and extending from the back wall of the header body, and a plurality of shield blades configured for insertion into the plurality of second openings, each of the plurality of shield blades having a first end extending from the front wall of the header body adjacent to the first end of a signal pin, a second end extending from the back wall of the header body adjacent to the second end of said signal pin and a generally right angle shielding portion configured to be disposed adjacent to an intermediate portion of said signal pin, wherein the first and second openings are arranged in the header body such that the generally right angle shielding portions of shield blades substantially surround the signal pins to form a coaxial shield around each of the plurality of signal pins.

6. The header connector of claim 1, wherein the first and second openings in the header body are arranged such that the generally right angle shielding portion of a shield blade is configured to be disposed adjacent to first and second sides of an associated signal pin and the generally right angle shielding portions of adjoining shield blades are configured to be disposed adjacent to remaining sides of the associated signal pin.

7. The header connector of claim 1 wherein the generally right angle shielding portion of each of the plurality of shield blades includes first and second leg portions, wherein each of the plurality of second openings in the header body has a generally right angle cross-section for receiving the generally right angle shielding portion of a shield blade, wherein each of the plurality of generally right angle second openings includes first and second narrowed throat portions dimensioned to engage the first and second leg portions of the generally right angle shielding portion of a shield blade to hold the shield blade in place.

8. The header connector of claim 1, wherein each of a plurality of signal pins includes a pin tail extending from a back wall of the header body to form an array of pin tails for engagement with a printed circuit board, wherein each of the plurality of shield blades includes a shield tail adjacent to a pin tail of a signal pin.

9. The header connector of claim 1 further including guide means for guiding insertion of a socket connector into the header connector when the socket connector and the header connector are mated to align the array of pin contacts of the header connector with an array of pin-insertion windows of the socket connector prior to insertion of the pin contacts of the header connector in the receptacle contacts of the socket connector.

* * * * *